US007279630B2

(12) United States Patent
Sasaki et al.

(10) Patent No.: US 7,279,630 B2
(45) Date of Patent: Oct. 9, 2007

(54) AUTOMATIC PLAYER MUSICAL INSTRUMENT, AUTOMATIC PLAYER USED THEREIN AND METHOD FOR EXACTLY CONTROLLING KEYS

(75) Inventors: Tomoya Sasaki, Shizuoka-ken (JP); Yuji Fujiwara, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 369 days.

(21) Appl. No.: 11/057,568

(22) Filed: Feb. 14, 2005

(65) Prior Publication Data

US 2005/0211079 A1 Sep. 29, 2005

(30) Foreign Application Priority Data

Mar. 12, 2004 (JP) ..... 2004-071388
Mar. 15, 2004 (JP) ..... 2004-072822
Sep. 21, 2004 (JP) ..... 2004-274022

(51) Int. Cl.
*G10H 3/00* (2006.01)
*G10H 1/00* (2006.01)
*G10F 1/02* (2006.01)

(52) U.S. Cl. ..... 84/723; 84/13; 84/21; 84/600

(58) Field of Classification Search ..... 84/600, 84/13, 723, 21

See application file for complete search history.

(56) References Cited

U.S. PATENT DOCUMENTS 4,913,026 A * 4/1990 Kaneko et al. ..... 84/21
5,022,301 A * 6/1991 Stahnke ..... 84/21
5,131,306 A 7/1992 Yamamoto
5,262,586 A * 11/1993 Oba et al. ..... 84/723
5,451,706 A * 9/1995 Yamamoto et al. ..... 84/34
5,530,198 A * 6/1996 Ishii ..... 84/21
5,568,138 A * 10/1996 Mantani ..... 341/20
5,650,580 A * 7/1997 Yamamoto et al. ..... 84/21
5,652,399 A * 7/1997 Fujiwara et al. ..... 84/21
5,663,513 A * 9/1997 Sugiyama et al. ..... 84/21
5,691,489 A * 11/1997 Fujiwara et al. ..... 84/21
5,739,450 A * 4/1998 Fujiwara et al. ..... 84/462
5,880,393 A * 3/1999 Kaneko et al. ..... 84/662

(Continued)

FOREIGN PATENT DOCUMENTS

JP 2275991 11/1990
JP 7175472 7/1995

*Primary Examiner*—Lincoln Donovan
*Assistant Examiner*—Christina Russell
(74) *Attorney, Agent, or Firm*—Harness, Dickey & Pierce, PLC

(57) ABSTRACT

An automatic playing system creates a feedback control loop for the keys incorporated in an acoustic piano; key sensors, which are provided under the front portions of the keys, informs a motion controller of current positions, and the motion controller periodically compares the current position and a current velocity with a target position on a reference trajectory and a target velocity to see whether or not a positional deviation and a velocity deviation occur; when the motion controller finds the deviations, the motion controller multiplies the deviations by a position gain and a velocity gain for determining an increment or decrement of the duty ratio of driving signals, and supplies the driving signals to the solenoid-operated actuators so as to accelerate or decelerate the keys; the gain is variable depending upon the key motion so that the actual key trajectory becomes close to the reference trajectory.

38 Claims, 16 Drawing Sheets

U.S. PATENT DOCUMENTS 6,051,762 A * 4/2000 Fujiwara et al. ..... 84/21
6,111,174 A * 8/2000 Oba et al. ..... 84/21
6,271,447 B1 * 8/2001 Fujiwara et al. ..... 84/21
6,297,437 B1 * 10/2001 Ura et al. ..... 84/423 R
6,362,405 B2 * 3/2002 Koseki et al. ..... 84/2
6,403,872 B2 * 6/2002 Muramatsu et al. ..... 84/724
6,515,213 B2 * 2/2003 Muramatsu et al. ..... 84/687
6,515,565 B1 * 2/2003 Muramatsu et al. ..... 335/299
6,858,789 B2 * 2/2005 Muramatsu et al. ..... 84/600
6,969,791 B2 * 11/2005 Fujiwara ..... 84/13
6,992,241 B2 * 1/2006 Fujiwara ..... 84/21
7,094,961 B2 * 8/2006 Ura et al. ..... 84/600
7,161,137 B2 * 1/2007 Ura et al. ..... 250/222.1
2001/0007220 A1 * 7/2001 Koseki et al. ..... 84/615
2002/0007717 A1 * 1/2002 Uehara ..... 84/600
2003/0070526 A1 * 4/2003 Muramatsu et al. ..... 84/21
2003/0133700 A1 * 7/2003 Uehara ..... 386/96
2005/0092160 A1 * 5/2005 Fujiwara ..... 84/600
2005/0145087 A1 * 7/2005 Fujiwara ..... 84/1
2005/0145781 A1 * 7/2005 Ura et al. ..... 250/222.1
2005/0150361 A1 * 7/2005 Muramatsu et al. ..... 84/626
2005/0211048 A1 * 9/2005 Fujiwara ..... 84/13
2005/0211049 A1 * 9/2005 Fujiwara et al. ..... 84/13
2005/0212846 A1 * 9/2005 Shinkawa et al. ..... 347/19
2005/0235801 A1 * 10/2005 Muramatsu et al. ..... 84/13
2005/0235808 A1 * 10/2005 Ishii et al. ..... 84/600
2005/0247182 A1 * 11/2005 Sasaki et al. ..... 84/13
2006/0016325 A1 * 1/2006 Fujiwara et al. ..... 84/723
2006/0090633 A1 * 5/2006 Muramatsu ..... 84/723

* cited by examiner

| | rx <3mm | 3mm≦rx |
|---|---|---|
| kx | 0. 9 | 0. 3 |

| | rx <0. 5mm | 0. 5mm≦rx |
|---|---|---|
| rv < 100mm/s | 8% | 9% |
| rv ≧ 100mm/s | 8% | 0.02 × (rv−100)+9% ··· Eq.1 |

Fig. 12

| | RELATIVELY LOW KEY VELOCITY REGION | | ORDINARY KEY VELOCITY REGION | |
|---|---|---|---|---|
| | rv≦200mm/s rx=0 to 4mm | rv≦200mm/s rx=4 to 10mm | rv>200mm/s rx=0 to 4mm | rv>200mm/s rx=4 to 10mm |
| Kx | 0. 6 | 0. 2 | 0. 6 | 0. 2 |
| Ky | 0. 3 | 0. 3 | 0. 3 | 0. 3 |
| $COR\text{-}RECT_f$ | 9% | 9% | 9+2×(rv−200)/100% | 9+2×(rv−200)/100% |

Fig. 16

AUTOMATIC PLAYER MUSICAL INSTRUMENT, AUTOMATIC PLAYER USED THEREIN AND METHOD FOR EXACTLY CONTROLLING KEYS

FIELD OF THE INVENTION

This invention relates to a control technology of an automatic player musical instrument and, more particularly, to an automatic player musical instrument, an automatic player incorporated therein and a method for controlling manipulators of the musical instrument.

DESCRIPTION OF THE RELATED ART

An automatic player piano is an example of the automatic player musical instrument, and is broken down into an acoustic piano and an automatic player. The automatic player includes an array of solenoid-operated key actuators with built-in plunger sensors and a controller. When a user requests the automatic player to reenact the performance, a set of music data codes is loaded to the controller. The controller sequentially analyzes the music data codes so as to determine reference trajectories on which the black/white keys are to travel. The reference trajectory means a series of target key positions varied with time. When the time comes, the controller supplies the driving signals to the associated solenoid-operated key actuators, and the solenoid-operated key actuators give rise to the key motion. While the black/white keys are traveling on the reference trajectories, the feedback signals, which represent the current key positions, are supplied from the built-in plunger sensors to the controller, and the controller compares the current key positions with the corresponding target key positions to see whether or not the black/white keys travel on the reference trajectories on schedule. If a black/white key is delayed or advanced, the controller accelerates or decelerates the plunger with the driving signal. Thus, the feedback loops are created in the automatic player, and the controller forces the black/white keys to travel on the reference trajectories on schedule.

The prior art automatic player piano is, by way of example, disclosed in Japan Patent Application laid-open No. Hei 7-175472, which is hereinafter referred to as "first laid-open". Although the position control is employed in the prior art automatic player piano, a speed control is applicable to the feedback control employed in the prior art automatic player piano disclosed in the first laid-open.

The "reference point" is further taught in the first laid-open. The loudness of tones is proportional to the velocity of the hammers incorporated in the acoustic piano. Although the black/white keys give rise to the hammer motion through the action units, the hammer velocity on most of the hammer trajectory is not proportional to the key velocity. However, the hammer velocity becomes proportional to the key velocity at the reference point. Although the reference point is not fixed among the acoustic pianos different in model, the reference point is found in the range between 9.0 millimeters and 9.5 millimeters below the rest positions of the keys.

The acoustic piano is equipped with a pedal system, and the pedals are further controlled in the prior art automatic player piano disclosed in Japan Patent Application laid-open No. Hei 2-275991, which is hereinafter referred to as "second laid-open". In the prior art automatic player piano disclosed in the second laid-open, the pedal positions are fed back to the controller, and the pedals are controlled through both of the position control and the speed control. Another teaching in the second laid-open is to eliminate the individualities of the acoustic pianos from the music data through the normalization process.

In the automatic player pianos, it is important to reproduce the key motion at a target key velocity equal to the key velocity in the original performance. In the first laid-open, the controller calculates the difference between a target key position/target key velocity on the reference trajectory and the corresponding current key position/current key velocity, and varies the mean current of the driving signal, if the controller notices the difference. However, the prior art servo-control technique hardly makes the black/white keys travel on the reference trajectory at the target key velocity. Especially, when the controller reproduces the repetition in the playback, the black/white key tends widely to deviate from the reference trajectory.

Although it is made effective against the deviation to enlarge the servo gain in the entire keystroke, the key motion becomes unstable, the black/white keys are liable to give rise to the multiple strike at the strings. Moreover, when the music data code requests the automatic player to faintly strike the strings with the hammer, the large servo gain makes the solenoid-operated key actuator bring the plunger into violently collision with the associated key, and noise occurs. Thus, there is a trade-off between the promptness and the stability in the prior art servo control. In order to compromise with the trade-off, the servo gain is fixed to a certain value for the compromise. In this situation, both promptness and stability are not achieved in the prior art automatic player disclosed in the first laid-open.

SUMMARY OF THE INVENTION

It is therefore an important object of the present invention to provide an automatic player musical instrument, in which manipulators exactly move on reference trajectories without sacrifice of the stability.

It is also an important object of the present invention to provide an automatic player, which makes the manipulators of a musical instrument exactly move on the reference trajectories without sacrifice of the stability.

It is another important object of the present invention to provide a method for controlling manipulators of a musical instrument, which forms a part of the automatic player musical instrument.

The present inventor firstly tried to apply the servo control technique disclosed in the second laid-open to an automatic player musical instrument for exactly control the velocity of the manipulators on the reference trajectories. However, the manipulators did not move on the reference trajectories at the target velocity. In fact, the prior art servo control technique disclosed in the second reference aimed at arrival at the target position. It was not proper to make the manipulators move at the target velocity on the reference trajectories.

To accomplish the object, the present invention proposes to vary at least one control parameter depending upon an actual motion or a target motion.

In accordance with one aspect of the present invention, there is provided an automatic player musical instrument for producing tones comprising an acoustic musical instrument including plural manipulators selectively manipulated for specifying tones to be produced and a tone generator connected to the plural manipulators and responsive to motion of the manipulators so as to produce the tones specified through the manipulated manipulators, and an automatic playing system including plural actuators provided for the plural manipulators and responsive to driving signals so as to give rise to actual motion of the manipulators for producing the tones, plural sensors monitoring the plural manipulators and producing detecting signals representing a current physical quantity which expresses the actual motion, a controller connected to the plural sensors and determining reference trajectories each expressed by a target physical quantity varied with time on the basis of pieces of music data for the manipulators to be manipulated by the plural actuators, at least another current physical quantity on the basis of the current physical quantity, at least another target physical quantity on the basis of the target physical quantity, deviations at least between the current physical quantity and the target physical quantity and between the aforesaid another current physical quantity and the aforesaid another target physical quantity, control parameters at least one of which is varied depending upon one of the actual motion and a target motion on the reference trajectories and an optimum magnitude of the driving signals through an arithmetic operation between the deviations and the control parameters and a signal modulator connected between the controller and the plural actuators, regulating each driving signal to the optimum magnitude and supplying the aforesaid each driving signal to the actuator associated with one of the manipulators to be manipulated.

In accordance with another aspect of the present invention, there is provided an automatic playing system for a musical instrument having manipulators and a tone generator comprising plural actuators provided for the plural manipulators, and responsive to driving signals so as to give rise to actual motion of the manipulators for producing tones through the tone generator, plural sensors monitoring the plural manipulators and producing detecting signals representing a current physical quantity which expresses the actual motion, a controller connected to the plural sensors and determining reference trajectories each expressed by a target physical quantity varied with time on the basis of pieces of music data for the manipulators to be manipulated by the plural actuators, at least another current physical quantity on the basis of the current physical quantity, at least another target physical quantity on the basis of the target physical quantity, deviations at least between the current physical quantity and the target physical quantity and between the aforesaid another current physical quantity and the aforesaid another target physical quantity, control parameters at least one of which is varied depending upon one of the actual motion and a target motion on the reference trajectories and a target magnitude of the driving signals through an arithmetic operation between the deviations and the control parameters, and a signal modulator connected between the controller and the plural actuators, regulating each driving signal to the optimum magnitude and supplying the aforesaid each driving signal to the actuator associated with one of the manipulators to be manipulated.

In accordance with yet another aspect of the present invention, there is provided a method for controlling manipulators of a musical instrument comprising the steps of a) determining a reference trajectory expressed by a target physical quantity varied with time for one of the manipulators to be actuated on the basis of a piece of music data, b) determining at least another target physical quantity on the basis of the target physical quantity, c) determining a deviation between the target physical quantity and a current physical quantity expressing an actual motion of the aforesaid one of the manipulators and another deviation between the aforesaid another target physical quantity and at least another current physical quantity determined on the basis of the current physical quantity, d) determining an optimum magnitude through at least one arithmetic operation between the deviations and control parameters, at least one of which is varied depending upon one of the actual motion and a target motion on the reference trajectories, e) regulating a driving signal to the optimum magnitude, f) supplying the driving signal to an actuator associated with the aforesaid one of the manipulators, and g) repeating the steps b), c), d), e) and f) until the aforesaid one of the manipulators arrives at a final target position.

BRIEF DESCRIPTION OF THE DRAWINGS

The features and advantages of the automatic player musical instrument, automatic player and method will be more clearly understood from the following description taken in conjunction with the accompanying drawings, in which FIG. 12 is a view showing a correction value table, FIG. 16 is a view showing a gain table for the feedback control loop shown in FIG. 15.

DESCRIPTION OF THE PREFERRED EMBODIMENTS

Figure 1:
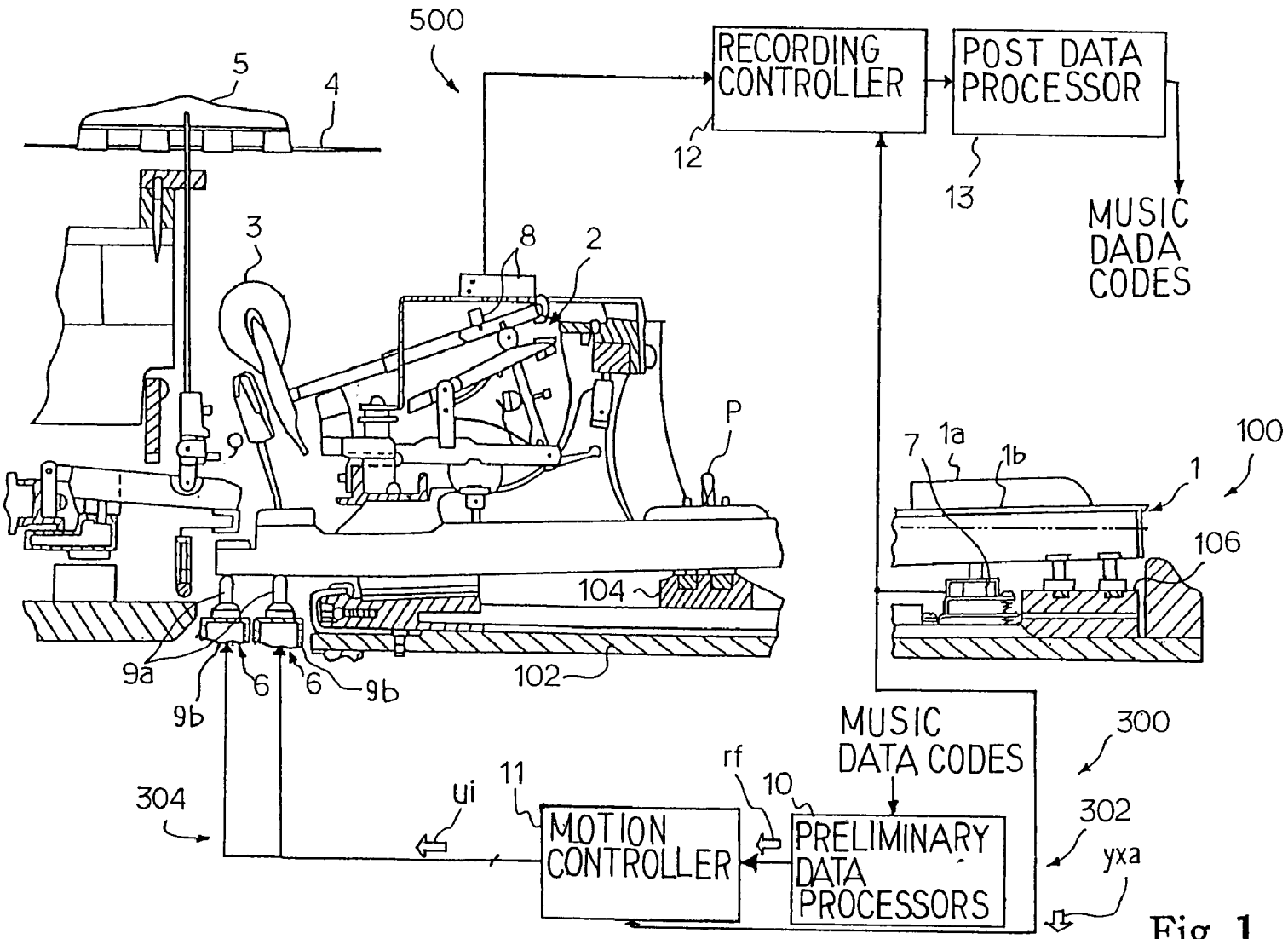
FIG. 1 is a schematic side view showing the structure of an automatic player piano according to the present invention.

In the following description, term "front" is indicative of a position closer to a player, who is sitting on a stool for fingering, than a position modified with term "rear". A line drawn between a front position and a corresponding rear position extends the "fore-and-aft" direction, and the lateral direction crosses the fore-and-aft direction at right angle.

An automatic player musical instrument embodying the present invention largely comprises an acoustic musical instrument such as, for example, a piano and an automatic player or automatic playing system. The component parts of the acoustic musical instrument are broken down into manipulators and a tone generator. A human player selectively manipulates the manipulators so as to specify tones to be produced. On the other hand, the tone generator is connected to the manipulators, and responsive to motion of the manipulators so as to produce the tones specified by the human player. In case where an acoustic piano serves as the acoustic musical instrument, black and white keys serve as the manipulators, and action units, hammers and strings as a whole constitute a tone generator.

On the other hand, the automatic player or automatic playing system is broken down into sensors, actuators, a controller and a signal modulator. The sensors, actuators, controller and signal modulator form a control loop, and the manipulators exactly travel on reference trajectories, which will be hereinafter described in detail, under the control of the control loop. Such a precise control on the manipulators results in a faithful reenactment of a performance.

The sensors monitor the manipulators, and produce detecting signals representative of a current physical quantity. The detecting signals are supplied from the sensors to the controllers. The current physical quantity expresses actual motion of the associated manipulator. A series of value of the current physical quantity expresses an actual trajectory on which the manipulator travels. The actual physical quantity is, by way of example, a keystroke or a current key position, a current velocity, a current acceleration or force presently exerted on the manipulator. Any sort of physical quantity is available in so far as the actual motion is definable with the sort of physical quantity. Accordingly, a position transducer, a velocity sensor, an acceleration sensor or a pressure sensor is available for the control loop.

The actuators are also provided for the manipulators, and give rise to actual motion of the associated manipulators. The actuators are connected through the signal modulator to the controller. The controller determines an optimum magnitude of the driving signals, and the signal modulator supplies driving signals, which is regulated to the optimum magnitude, to the actuators so as to make the actuators to give rise to the actual motion. Thus, the automatic playing system performs a piece of music without any fingering of the human player. The actuator may be implemented by a solenoid-operated actuator. However, another sort of actuator such as, for example, a pneumatic actuator or a pulse motor is available for the automatic playing system.

The function of the controller is broken down into the followings. The controller realizes the following functions through a computer program, which runs on a processor. However, a wired logic circuit may realize the following functions.

First, the controller determines reference trajectories on the basis of pieces of music data for the manipulators to be actuated. The reference trajectory is a series of values of a target physical quantity varied with time, and pieces of music data may be prepared in the form of binary codes.

Second, the controller determines another sort of current physical quantity and another sort of target physical quantity. The current physical quantity and another current physical quantity are respectively corresponding to the target physical quantity and another target physical quantity. In case where the current physical quantity and another current physical quantity are the position and velocity, the target physical quantity and another target physical quantity are also position and velocity. However, two sorts of physical quantity do not set any limit to the technical scope of the present invention. Three sorts of physical quantity such as, for example, the position, velocity and acceleration may be employed for the control on the manipulators.

Third, the controller compares the current physical quantity and another current physical quantity with the target physical quantity and another physical quantity to see whether or not each manipulator is exactly traveling on the reference trajectory. If the answer is negative, the controller determines the first deviation, which is the difference between the current physical quantity and the target physical quantity, and the second deviation, which is the difference between another current physical quantity and another target physical quantity. In case where three sorts of physical quantity are examined, the controller further determines the third deviation between yet another current physical quantity and yet another target physical quantity.

Fourth, the controller determines control parameters for the deviations. At least one of the control parameters is variable depending upon the motion on the trajectory. The "motion on the trajectory" is described from various viewpoints such as the target physical quantity, another target physical quantity, current physical quantity, another current physical quantity or any combination thereamong. If yet another physical quantity is examined, the candidates are further increased.

Finally, the controller determines an optimum magnitude of driving signal. The optimum magnitude means that, when the driving signal is adjusted to the optimum magnitude, the actuator reduces the deviations without sacrifice of the stability of the motion. The optimum magnitude is determined through an arithmetic operation or arithmetic operations on the deviations and control parameters. Since at least one of the control parameters is variable depending upon the motion on the trajectory, the actual trajectory gets closer to the reference trajectory. The controller supplies a piece of control data representative of the optimum magnitude to the signal modulator.

The signal modulator adjusts the driving signal to the optimum magnitude, and supplies the driving signal to the actuator associated with each manipulator on the actual trajectory.

As will be appreciated from the foregoing description, the automatic playing system faithfully reenacts the performance, which the pieces of music data express by virtue of the variable control parameter or parameters.

Description is made on several embodiments of the automatic player musical instrument in more detail.

First Embodiment

Referring to FIG. 1 of the drawings, an automatic player piano embodying the present invention largely comprises an acoustic piano 100, an automatic playing system 300 and a recording system 500. The automatic playing system 300 and recording system 500 are installed in the acoustic piano 100, and are selectively activated depending upon the mode of operation. While a player is fingering a piece of music on the acoustic piano 100 without any instruction for recording and playback, the acoustic piano 100 behaves as similar to a standard acoustic piano, and generates the piano tones at the pitch specified through the fingering.

When the player wishes to record his or her performance on the acoustic piano 100, the player gives the instruction for the recording to the recording system 500. Then, the recording system 500 is activated. While the player is fingering on the acoustic piano 100, the recording system 500 produces music data codes representative of the performance on the acoustic piano 100. Thus, the performance is recorded in a set of music data codes.

A user is assumed to wish to reproduce the performance. The user instructs the automatic playing system 300 to reproduce the acoustic tones. The automatic playing system 300 fingers the piece of music on the acoustic piano 100, and reenacts the performance without the fingering of the human player.

The acoustic piano 100, automatic playing system 300 and recording system 500 are hereinafter described in detail.

Acoustic Piano

In this instance, the acoustic piano 100 isa grand piano. The acoustic piano 100 includes a keyboard 1, action units 2, hammers 3, strings 4 and dampers 5. A key bed 102 forms a part of a piano cabinet, and the keyboard 1 is mounted on the key bed 102. The keyboard 1 is linked with the action units 2 and dampers 5, and a pianist selectively actuates the action units 2 and dampers 5 through the keyboard 1. The dampers 5, which have been selectively actuated through the keyboard 1, are spaced from the associated strings 4 so that the strings 4 get ready to vibrate. On the other hand, the action units 2, which have been selectively actuated through the keyboard 1, give rise to free rotation of the associated hammers 3, and the hammers 3 strike the associated strings 4 at the end of the free rotation. Then, the strings 4 vibrate, and the acoustic tones are produced through the vibrations of the strings 4. Thus, the keyboard 1, action units 2, dampers 5, hammers 3 and strings 4 behave as similar to those of a standard acoustic piano.

The keyboard 1 includes plural black keys 1*a*, plural white keys 1*b* and a balance rail 104. In this instance, eighty-eight keys 1*a*/1*b* are incorporated in the keyboard 1. The black keys 1*a* and white keys 1*b* are laid on the well-known pattern, and are movably supported on the balance rail 104 by means of balance key pins P. While any force is not exerted on the black/white keys 1*a*/1*b*, the hammers 3 and action units 2 exert the self-weight on the rear portions of the black/white keys 1*a*/1*b*, and the front portions of the black/white keys 1*a*/1*b* are spaced from the front rail 106 as drawn by real lines. The key position indicated by the rear lines is "rest position", and the keystroke is zero. When a pianist depresses the black/white keys 1*a*/1*b*, the front portions are sunk against the self-weight of action units/hammers 2/3, and reach "end positions" indicated by dots-and-dash lines. The end positions are spaced from the rest positions along the key trajectories by 10 millimeters. In other words, the keystroke from the rest positions to the end positions is 10 millimeters.

A user is assumed to depress the front portions of the black and white keys 1*a*/1*b*. The front portions are sunk toward the front rail 106, and the rear portions are raised. The key motion gives rise to the activation of the associated action units 2, and further causes the strings 4 to get ready for the vibrations as described hereinbefore. The activated action units 2 drive the associated hammers 3 for the free rotation through the escape. The hammers 3 strike the associated strings 4 at the end of the free rotation for producing the acoustic tones. The hammers 3 rebound on the strings 4, and are dropped onto the associated key action units 2, again.

When the user releases the black and white keys 1*a*/1*b*, the self-weight of the action units/hammers 2/3 gives rise to the rotation of the black and white keys 1*a*/1*b* in the counter direction so that the black and white keys 1*a*/1*b* return to the rest positions. The dampers 5 are brought into contact with the associated strings 4 so that the acoustic tones are decayed. The key action units 2 return to the rest positions, again. Thus, the human pianist can give rise to the angular key motion about the balance rail 104 like a seesaw.

Automatic Playing System

Figure 2:
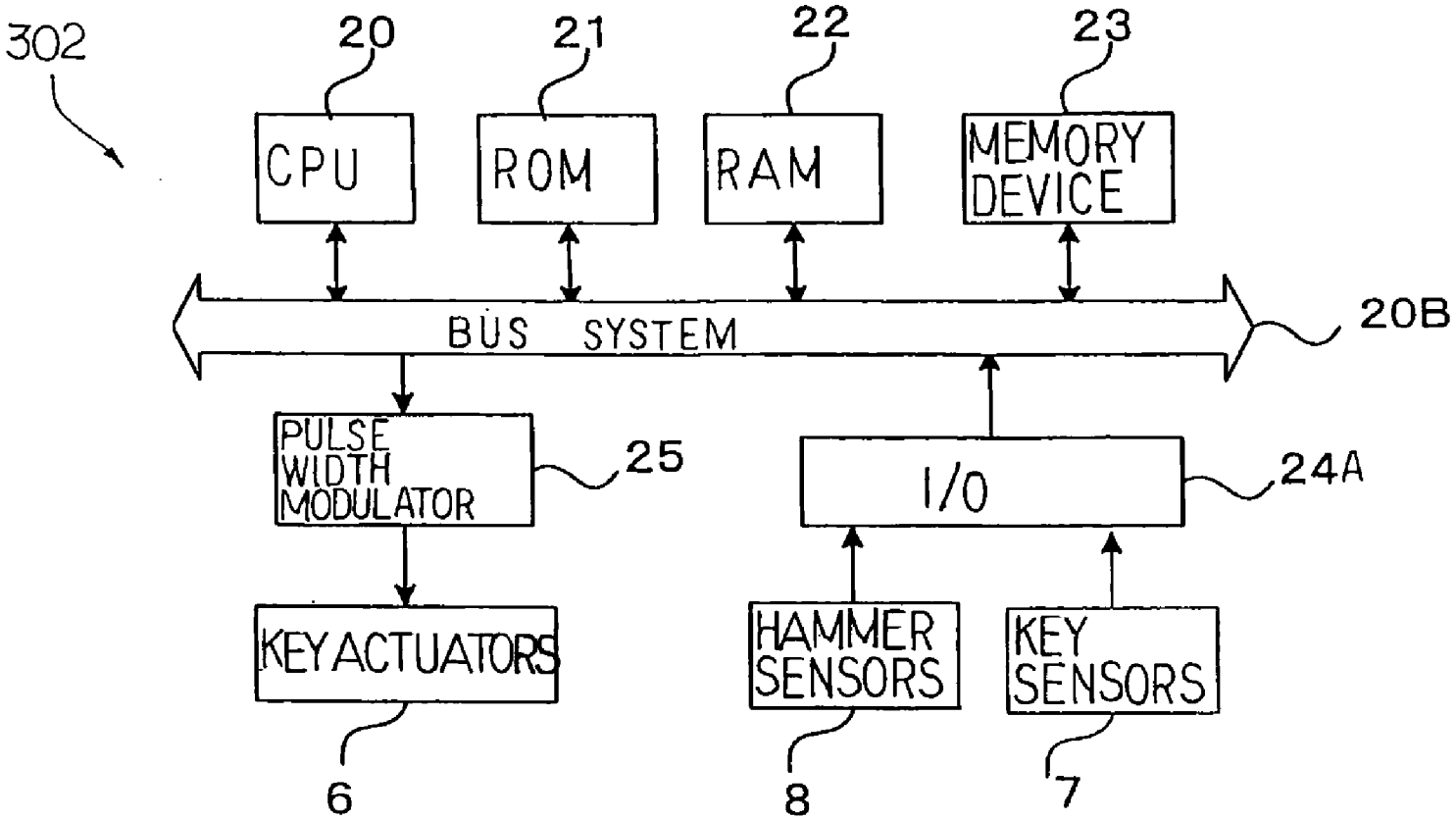
FIG. 2 is a block diagram showing the system configuration of a controller incorporated in the automatic player piano.

Description is hereinafter made on the automatic playing system 300 and recording system 500 with reference to FIG. 2 concurrently with FIG. 1. The automatic playing system 300 includes an array of key actuators 6, key sensors 7, a memory device 23, a manipulating panel (not shown) and a controller 302. On the other hand, the recording system 500 includes hammer sensors 8, the key sensors 7, memory device 23, controller 302 and manipulating panel (not shown). Thus, the system components 7, 23 controller 302 and manipulating panel (not shown) are shared between the automatic playing system 300 and the recording system 500.

The function of the controller 302, which forms a part of the automatic playing system 300, is broken down into a preliminary data processor 10 and a motion controller 11. A set of music data codes representative of the performance to be reenacted is loaded to the preliminary data processor 10, and the key sensors 7 supplies key position signals representative of current key positions to the motion controller 11. The key position signals serve as feedback signals yxa. The preliminary data processor 10 sequentially analyzes the music data codes, and determines the piano tones to be reproduced and timing at which the piano tones are reproduced. When the time comes, the preliminary data processor 10 determines reference trajectories for the black/white keys 1*a*/1*b*, and supplies a control data signal rf representative of the reference trajectories to the motion controller 11. The reference trajectory is a set of target key positions varied with time. The hammer 3 obtains the final hammer velocity, which is proportional to the loudness of tone, on the condition that the associated black/white key 1*a*/1*b* travels on the reference trajectory. The reference trajectory is described in the first laid-open. The motion controller 11 supplies the driving signals ui to the solenoid-operated key actuators 6, and periodically regulates the driving signal ui to proper values of the mean current through comparison between the target key positions on the reference trajectories and current key positions so as to force the black/white keys 1*a*/1*b* to travel on the reference trajectories.

On the other hand, the function of the controller 302, which forms a part of the recording system 500, is broken down into a recording controller 12 and a post data processor 13. The hammer sensors 8 supplies hammer position signals, which represent current hammer positions, to the recording controller 12, and the recording controller 12 determines the final hammer velocity and the time at which the strings 4 are struck with the hammers 3. The recording controller 12 further determines the key numbers assigned to the depressed/released keys 1*a*/1*b*, key velocity and time at which the pianist starts to depress the black/white keys 1*a*/1*b*. The recording controller 12 analyzes these pieces of music data representative of the key motion and hammer motion, and supplies pieces of event data to the post data processor 13. The post data processor 13 normalizes the pieces of event data. The pieces of normalized event data are coded by the post data processor 13 in the appropriate formats defined in protocols such as, for example, the MIDI (Musical Instrument Digital Interface) protocols. The process for the normalization is disclosed in the second laid-open.

The key actuators 6 are independently energized with the driving signal ui for moving the associated black and white keys 1*a*/1*b*. This means that the key actuators 6 to be required is equal in number to the black and white keys 1*a*/1*b*. In this instance, the key actuators 6 are implemented by solenoid-operated actuator units.

Each of the solenoid-operated key actuator units 6 includes a plunger 9*a* and a combined structure of a solenoid and yoke 9*b*. The solenoids are housed in the yoke, and plungers 9*a* are projectable from and retractable into the solenoids. The array of solenoid-operated key actuator units 6 is hung from the key bed 102. While the solenoid-operated key actuator units 6 are standing idle without any driving signal ui, the plungers 9*a* are retracted in the combined structure of solenoid and yoke 9*b*, and the tips of the plungers 9*a* are slightly spaced from the lower surfaces of the associated black and white keys 1*a*/1*b* at the rest positions.

When the controller 302 energizes the solenoid 9*b* with the driving signal ui, magnetic field is created around the plunger 9*a*, and the magnetic force is exerted on the plunger 9*a* in the magnetic field. Then, the plunger 9*a* upwardly projects from the combined structures 9*b*, and pushes the lower surface of the black and white key 1*a*/1*b* so as to give rise to the angular motion of the associated black/white keys 1*a*/1*b*. The black/white key 1*a*/1*b* actuates the associated action unit 2, and the jack, which forms a part of the action unit 2, escapes from the hammer 3. The hammer 3 starts the free rotation through the escape, and the string 4 is struck with the hammer 3 at the end of the free rotation. Although the solenoid-operated key actuators 6, black/white keys 1*a*/1*b*, action units 2 and hammers 3 are mechanically independent of one another, the solenoid-operated key actuators 6 sequentially give rise to the key motion, escape of jacks and free rotation of hammers 3 so as to produce the piano tones.

The black/white keys 1*a*/1*b* are respectively monitored with the key sensors 7. The key sensors 7 are provided under the front portions of the black/white keys 1*a*/1*b*, and have respective detectable ranges overlapped with the full keystrokes. The key sensors 7 create optical beams across the trajectories of the associated black/white keys 1*a*/1*b*, and the amount of light is varied depending upon the current key position of the associated black/white key 1*a*/1*b*. Thus, the key sensors 7 are categorized in an optical position transducer, and the structure of the key sensors 7 is, by way of example, disclosed in the first laid-open.

The amount of light is representative of the current key position, and is converted to photo current. The photo current forms the key position signals representative of the current key positions, and the key position signals are supplied to the controller 302. The magnitude of the key position signals is varied in dependence on the current key positions, and the rate of change expresses the key velocity. The key position signals are supplied from the key sensors 7 to both of the recording controller 12 and the motion controller 11 so as to be used in both of the recording and the servo-controlling on the black/white keys 1*a*/1*b* as described hereinbefore.

The hammer sensors 8 are also implemented by an optical position transducer. The optical position transducers disclosed in Japan Patent Application laid-open No. 2001-175262 are available for the hammer sensors 8. The hammer sensors 8 are incorporated in the recording system 500, and the hammer position signals are supplied to the recording controller 12.

The controller 302 includes a central processing unit 20, which is abbreviated as "CPU", a read only memory 21, which is abbreviated as "ROM", a random access memory 22, which is abbreviated as "RAM", a bus system 20B, an interface 24A, which is abbreviated as "I/O" and a pulse width modulator 25. These system components 20, 21, 22, 24 and 25 are connected to the bus system 20B, and the memory device 23 is further connected to the bus system 20B. Address codes, control data codes and music data codes are selectively propagated from particular system components to other system components through the bus system 20B.

The central processing unit 20 is the origin of the data processing capability. A main routine program, subroutine programs and data/parameter tables are stored in the read only memory 21, and the computer programs runs on the central processing unit 20 so as to accomplish the jobs as the preliminary data processor 10, motion controller 11, recording controller 12 and post data processor 13. One of the data tables is used for determining a feedback gain kx as will be hereinlater described in detail, and is hereinafter referred to as "gain table". The random access memory 22 offers a temporary data storage, and serves as a working memory.

The memory device 23 offers a large amount of memory to both automatic playing and recording systems 300/500. The music data codes are temporarily stored in the memory device 23 in the recording and playback. In this instance, the memory device 23 is implemented by a hard disk driver. A flexible disk driver or floppy disk (trademark) driver, a compact disk driver such as, for example, a CD-ROM driver, a magnetic-optical disk driver, a ZIP disk driver, a DVD (Digital Versatile Disk) driver and a semiconductor memory board are available for the systems 300/500.

The hammer sensors 8, key sensors 7 and manipulating panel (not shown) are connected to the interface 24A and the pulse width modulator 25 distributes the driving signal ui to the solenoid-operated key actuators 6. The key position signals and hammer position signals reach the interface 24A. The interface 24A appropriately reshapes the waveform of the hammer position signals and the key position signals, and, thereafter, converts the hammer position signals and key position signals to digital hammer position signals and digital key position signals by means of an analog-to-digital converter. After the analog-to-digital conversion, the central processing unit 20 periodically fetches the pieces of positional data representative of the current key positions and pieces of positional data representative of the current hammer positions from the interface 24A. The controller 302 may further include a communication interface, to which music data codes are supplied from a remote data source through a public communication network.

In this instance, the central processing unit 20, pulse width modulator 25, key actuators 6, key sensors 7 and interface 24A forms a feedback control loop 304, and the black and white keys 1*a*/1*b* are inserted into the feedback control loop 304.

As described hereinbefore, the motion controller 11 is responsive to the control data signal representative of the reference trajectories so as to force the black/white keys 1*a*/1*b* to travel thereon with the driving signal ui. The purpose of the servo-control is to impart the final hammer velocity to the associated hammers 3. This purpose is accomplished by forcing the black/white keys 1*a*/1*b* to travel on the reference trajectories. In this instance, the full keystroke is of the order of 10 millimeters so that the motion controller 11 is expected faithfully to reproduce the key motion on the short reference trajectories. Nevertheless, the solenoid-operated key actuators 6 are mechanically independent of the associated black and white keys 1*a*/1*b*, and the feedback signals yxa represent the key motion, which the solenoid-operated key actuators 6 give rise to. This means that various sorts of noise components are liable to take place. However, these noise components are not taken into account in the prior art servo-control. The gain is to be changed depending upon the target key positions on the reference trajectory.

Servo Control

Figure 3:
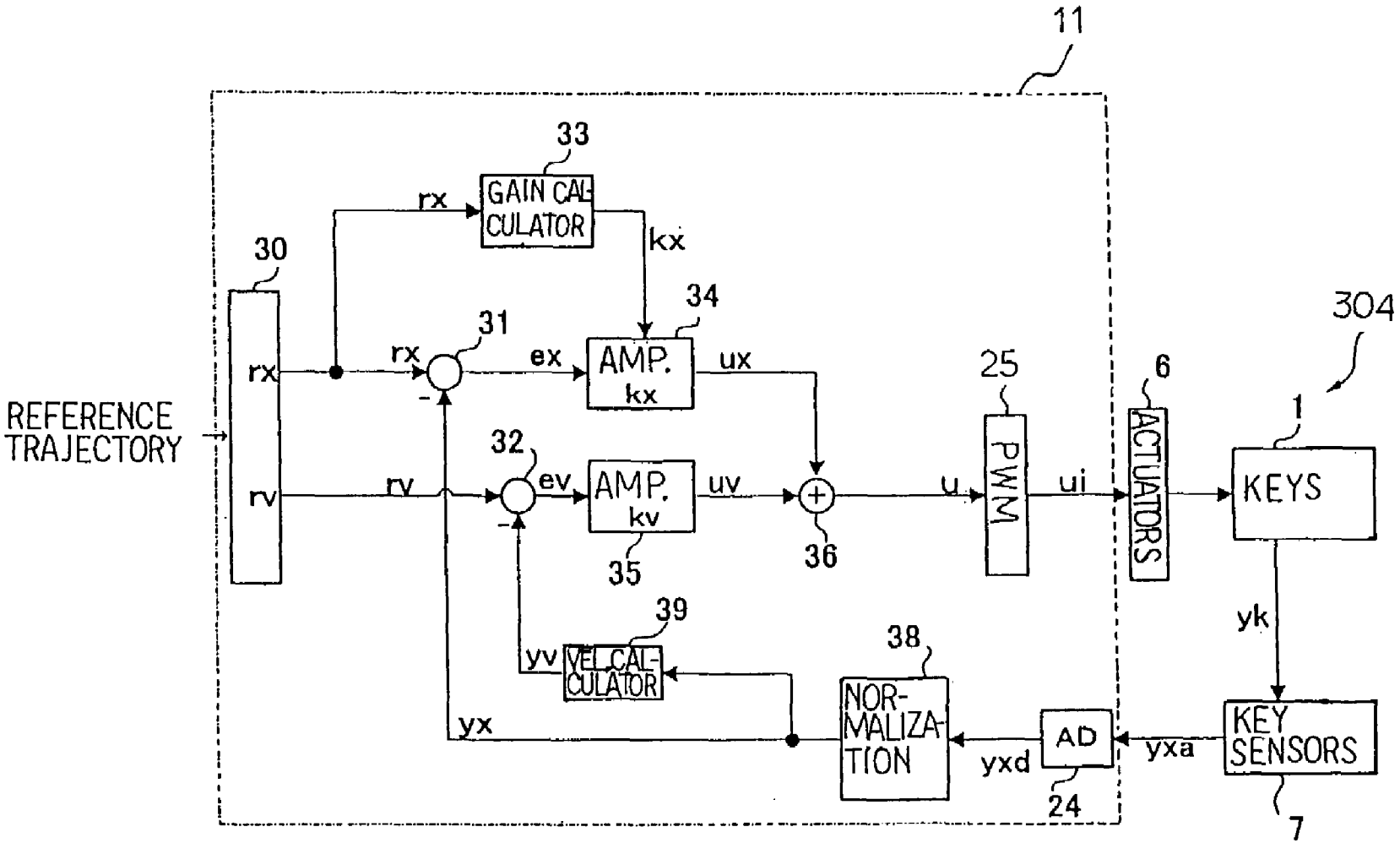
FIG. 3 is a block diagram showing the functions of a feedback control loop incorporated in the automatic player piano.

FIG. 3 shows the function of the motion controller 11 for the servo control on the black/white keys 1*a*/1*b*. In this instance, the motion controller 11 is implemented by the software.

In FIG. 3, circles 31 and 32 stand for subtractors, and circle 36 represents an adder. Box 24 represents the analog-to-digital converter incorporated in the interface 24A, and box 30 stands for the determination of the target key position rx and target key velocity rv at each sampling time period. The central processing unit 20 fetches the digitai key position signals yxd from the analog-to-digital converter 24 once in each sampling time period, and is repeated at intervals of 1 millisecond. Box 33 represents a gain calculator. The gain calculator 33 analyzes the target key position rx, and determines a value of position gain kx on the basis of the target key position rx. Boxes 34 and 35 stand for amplifiers. The amplifier 34 multiplies a positional deviation ex by the position gain kx, and the other amplifier multiplies a velocity deviation ev by a velocity gain kv. Boxes 25 and 38 stand for the function of the pulse width modulator 25 and normalization 38, respectively. Box 39 stands for a velocity calculator, which determines a current key velocity yv on the basis of a predetermined numbers of current key positions on the reference trajectory.

Assuming now that a reference trajectory represents the full keystroke from the rest position to the end position, the box 30 outputs the target key position on the reference trajectory and target key velocity once in each sampling time period. In this instance, the target key position is varied from zero to 10 millimeters, and the unit is millimeter. On the other hand, the target key velocity is varied from zero to 500 millimeters/second, and the unit is millimeter/second.

The box 30 is assumed to output a target key position rx and a target key velocity rv. The target key position rx and target key velocity rv are respectively supplied to the subtractors 31 and 32, and a value of the current key position yx, which have been already subjected to the normalization at the box 38, and a value of the current key velocity yv, which is determined on the basis of the normalized current key positions, are respectively subtracted from the value of the target key position rx and the value of the target key velocity rv through the subtractors 31 and 32. The positional deviation ex and velocity deviation ev are respectively supplied from the subtractors 31 and 32 to the amplifiers 34 and 35, and are multiplied by the position gain kx and velocity gain kv through the multiplication in the amplifiers 34 and 35. Although the velocity gain kv is constant, the position gain kx is varied together with the target key position rx.

In detail, the target key position rx is concurrently supplied to the subtractor 31 and gain calculator 33. As described hereinbefore, the values of position gain kx are tabled in the read only memory 21. In the gain table, the values of position gain kx are correlated with the values of the target key position rx. When the target key position rx reaches the gain calculator 33, the gain calculator 33 accesses the gain table, and reads out the appropriate value of the position gain kx from the gain table.

Figures 4, 5A:
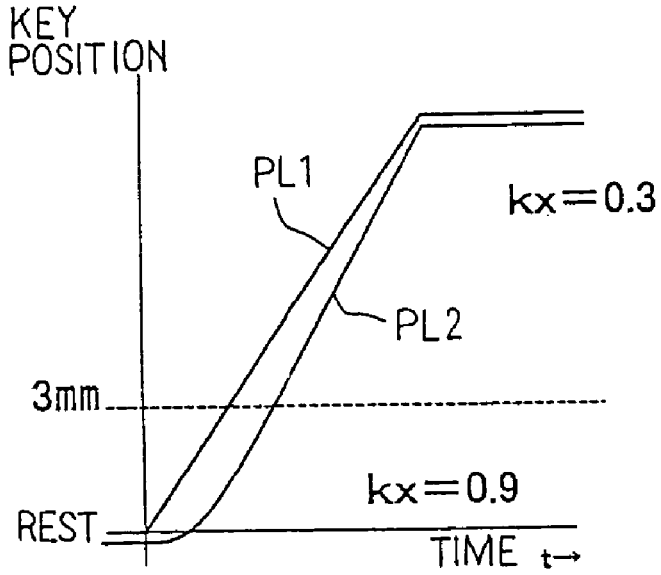
FIG. 4 is a table showing a relation between a target key position and a value of position gain.
FIG. 5A is a graph showing an actual key trajectory and a reference trajectory.

FIG. 4 shows the position gain table. In this instance, the keystroke is divided into two regions, i.e., the target key position rx is less than 3 millimeters and the target key position rx is equal to or greater than 3 millimeters. If the target key position rx is less than 3 millimeters from the rest position, the position gain kx is 0.9. On the other hand, if the target key position rx is fallen within the next region, i.e., equal to or greater than 3 millimeters, the position gain kx is decreased to 0.3. Thus, while the black/white keys 1*a*/1*b* are traveling in the shallow region, the black/white keys 1*a*/1*b* are strongly accelerated or decelerated. However, the motion controller 11 delicately controls the black/white keys 1*a*/1*b* after entry into the deep region where the reference point exists.

The positional deviation ex, which is expressed by millimeters as unit, is converted to the proportion of the increment/decrement of the duty ratio through the multiplication in the amplifier 34. Similarly, the velocity deviation ev, which is expressed by millimeters per second as unit, is converted to the proportion of the increment/decrement of the duty ratio through the multiplication in the amplifier 35. In other words, the duty ratio is increased or decreased by the total percentage. In this instance, the key velocity is heavily weighted rather than the key position. For this reason, the velocity gain kv is greater than the position gain kx.

The variable position gain kx makes the solenoid-operated key actuators 6 force the black/white keys 1*a*/1*b* timely to reach the target key position on the reference trajectory. The key velocity at the reference point becomes equal to that in the original performance in so far as the black/white key 1*a*/1*b* exactly travels on the reference trajectory. This results in the generation of the piano tone at the loudness equal to that in the original performance.

Turning back to FIG. 3, the products ux and uv are supplied to the adder 36. The product ux is added to the other product uv at the adder 36, and the sum u is supplied to the pulse width modulator 25. The pulse width modulator 25 varies the duty ratio of the driving signal ui depending upon the sum u. If the sum u is zero, the motion controller 11 predicts that the black/white key 1*a*/1*b* timely reaches the target position rx, and the pulse width modulator 25 keeps the driving signal ui at the present duty ratio. However, if not, the pulse width modulator 25 regulates the driving signal ui to a proper duty ratio, and makes the black/white key 1*a*/1*b* accelerated or decelerated.

The driving signal ui is supplied to the solenoid-operated key actuator 6. When the pulse width modulator 25 varies the duty ratio, the magnetic field is made strong or weak, and, accordingly, the force on the plunger 9*a* is increased or decreased. Thus, the solenoid-operated key actuator 6 accelerates or decelerates the associated black/white keys 1*a*/1*b*. If, on the other hand, the pulse width modulator 25 keeps the driving signal ui at the previous duty ratio, the force on the plunger 9*a* is not varied, and the solenoid-operated key actuator 6 keeps the black/white key 1*a*/1*b* at the previous key velocity.

The key sensor 7 determines the current key position yk, and supplies the key position signal yxa to the interface 24A. The analog key position signal yxa is converted to the digital key position signal yxd through the analog-to-digital conversion, and the digital key position signal yxd is normalized at the box 38. The individuality of the acoustic piano 100 is eliminated from the current key position expressed by the digital key position signal yxd.

The current key positions are differentiated for the current key velocity. A polynomial approximation may be used in the calculation of the current key velocity. For example, every seven current key positions are approximated to a quadratic curve, and determine the current key velocity on the basis of the quadratic curve.

The current key position yx and current key velocity yv are fed back to the subtractors 31 and 32, and are respectively compared with the next target key position rx and next target key velocity rv in the next sampling time period.

The present inventor evaluated the variable position gain kx. The present inventor prepared the gain table, and observed the actual key motion. Plots PL1 were representative of a reference trajectory for a key (see FIG. 5A). While the motion controller 11 was controlling the key through the feedback loop 304 shown in FIG. 3, the key traveled along plots PL2.

Figure 5B:
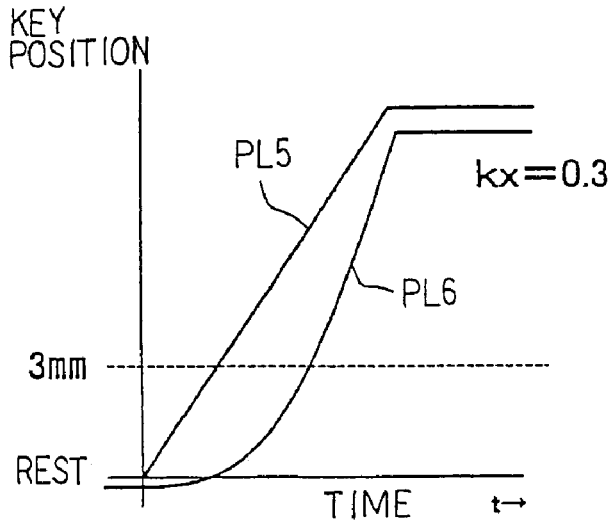
Fig. 5 B PRIOR ART
FIGS. 5B and 5C are graphs showing actual key trajectories and the reference trajectory.

The present inventor fixed the gain kx to 0.3 over the full keystroke, and the observed the key motion. Plots PL5 were also the reference trajectory for the key (see FIG. 5B). While the motion controller 11 was controlling the key through the feedback loop 304, the key traveled along plots PL6. The current key positions in the shallow region was widely spaced from the reference trajectory PL5. The poor promptness in the shallow region was serious in quick repetition, because the acoustic piano 100 was liable to miss a tone.

Figure 5C:
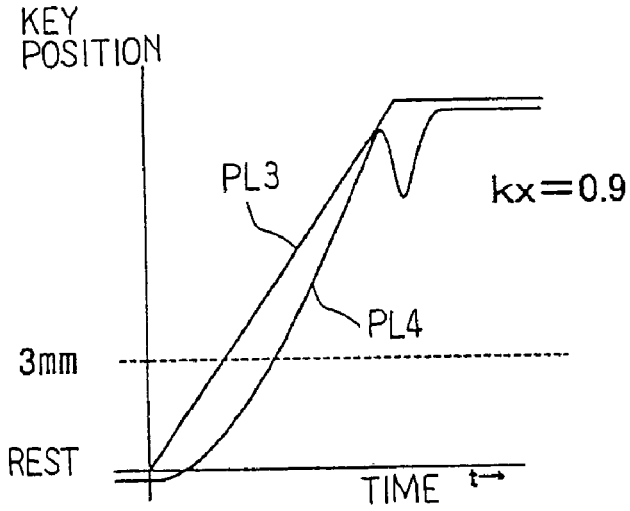
Fig. 5 C PRIOR ART

The present inventor changed the position gain kx to 0.9 over the full keystroke. Plots PL3 also stood for the reference trajectory (see FIG. 5C). While the motion controller 11 was controlling the key through the feedback loop 304, the key traveled along plots PL4. The key motion became unstable in the deep region. The unstable key motion was resulted in unintentional double strike.

Comparing plots PL2 with plots PL6 and PL4, it was understood that the variable position gain kx made the key motion closer to the key motion under the feedback control at the fixed gains. While the key was traveling from the rest position to 3 millimeters below the rest position, the key promptly rose by virtue of the relatively large position gain kx so that the plots PL2 were closer to the reference trajectory PL1 than the plots PL6 were. Even though the key got close to rest position, the relatively small position gain kx kept the key motion stable, and any double strike did not occur. Thus, the variable gain enhanced the promptness without sacrifice of the stability.

Modifications

As described hereinbefore, the position gain kx is varied depending upon the target key position rx on the reference trajectory in the feedback loop 304 shown in FIG. 3. In the first modification, the velocity gain kv is varied depending upon the target position rx.

Figure 6A:
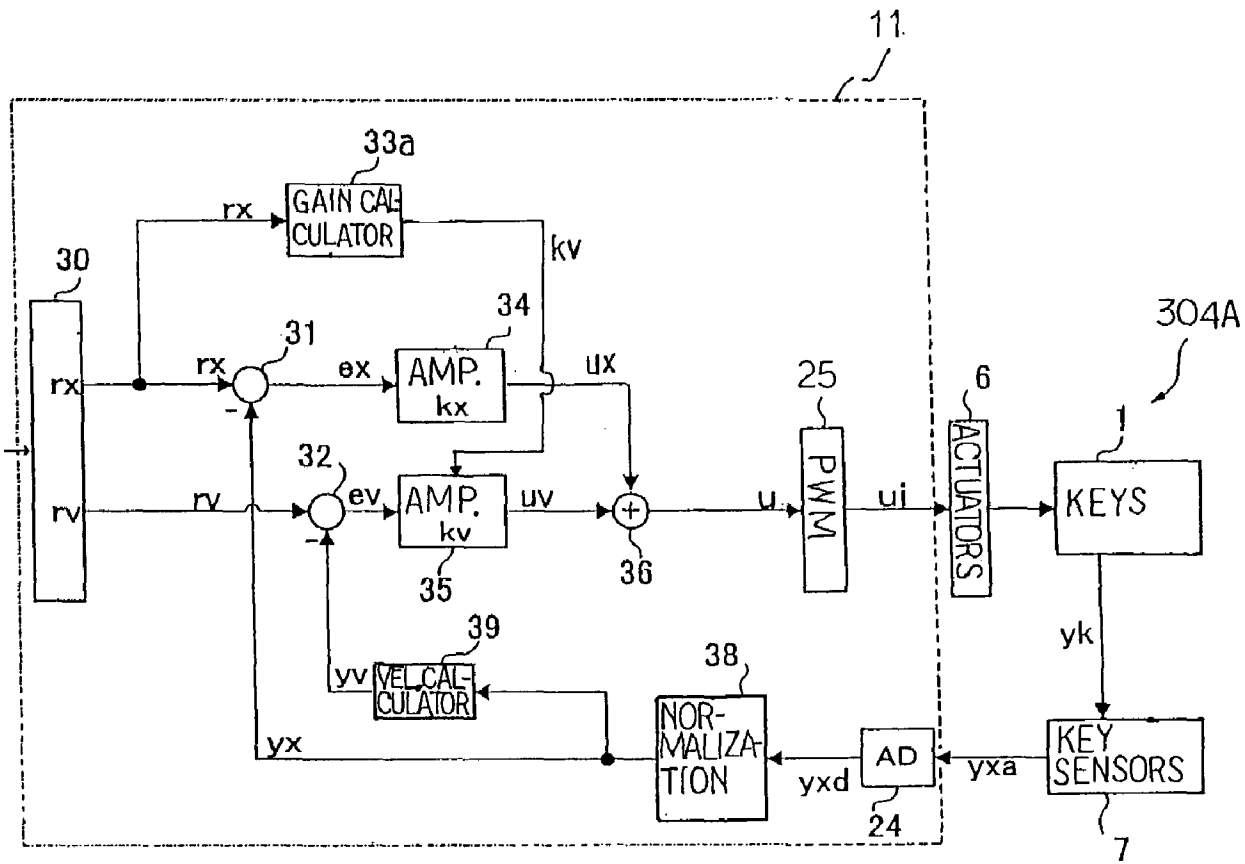
FIG. 6A is a block diagram showing a modification of the feedback control loop incorporated in the automatic player piano.
Figure 6B:
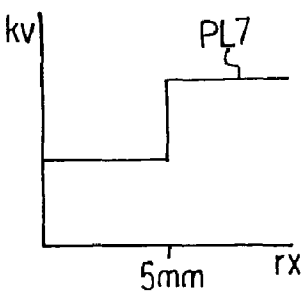
FIG. 6B is a graph showing a relation between a target key position and a velocity gain.

The black/white keys 1*a*/1*b* are controlled through a feedback loop 304A as shown in FIG. 6A. A gain table, which defines relation between the target key position rx and the velocity gain kv, is stored in the read only memory 21 or random access memory 22, and the gain calculator 33*a* accesses the gain table so as to read out a corresponding value of the velocity gain kv for the target key velocity rv. The velocity gain kv is supplied to the amplifier 35, and the amplifier 35 multiplies the target key velocity rv by the velocity gain kv. In this instance, the velocity gain kv is varied as indicated by plots PL7 in FIG. 6B. While the key is traveling in a shallow region between the rest position and the target key position 5 millimeters spaced from the rest position, the velocity gain kv takes a relatively small value. The key position on the boundary is merely appropriate for the acoustic piano 100. If the automatic playing system is installed in another model, the boundary is different from the key position 5 millimeters spaced from the rest position. After entry into the deep region, which is between the target key position and the end position, the velocity gain kv takes a relatively large value. If a relatively large velocity gain kv, which is greater than a critical value, is applied to the servo control in the shallow region, the relatively large velocity gain kv makes the key motion unstable. In this instance, Although the velocity gain kv is relatively large in the shallow region, the velocity gain kv is equal to or less than the critical value so that the promptness is enhanced in the shallow region without sacrifice of the stability. The other control steps are similar to those of the first embodiment, and, for this reason, description is omitted for the sake of simplicity.

Figure 7A:
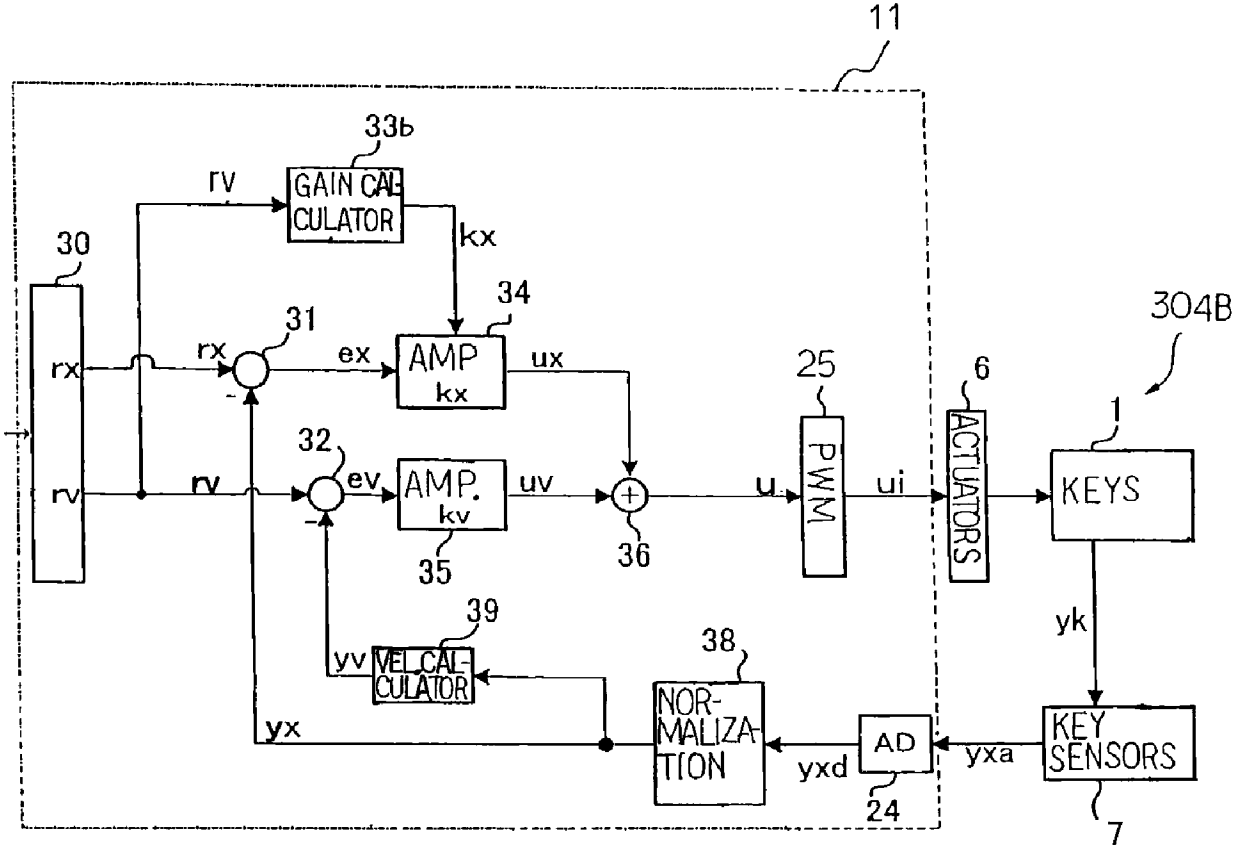
FIG. 7A is a block diagram showing another modification of the feedback control loop incorporated in the automatic player piano.
Figure 7B:
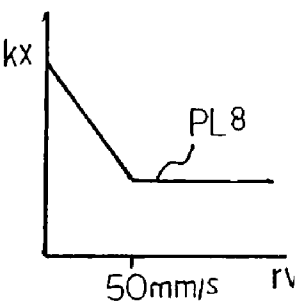
FIG. 7B is a graph showing a relation between a target key velocity and a position gain.

FIG. 7A shows another modification 304B of the feedback loop 304. In this instance, the gain calculator 33*b* is responsive to the target key velocity rv so as to determine the position gain kx. A gain table, which defines a relation between the target key velocity rv and the position gain kx, is stored in the read only memory 21 or random access memory 22. In this instance, the position gain kx is reduced inversely proportional to the target key velocity rv in a relatively slow key motion, and is constant in a relatively fast key motion as indicated by plots PL8 in FIG. 7B. A threshold, i.e., the boundary between the relatively slow key motion and the relatively fast key motion is, by way of example, 50 millimeters per second. The threshold is experimentally determined. While the key is traveling at relatively low speed, a large value of the velocity gain kv is supplied to the amplifier 34, and the duty ratio is strongly influenced by the positional deviation ex. In other words, when the controller 11 acknowledges that the key is to travels at a high speed, the position gain kx is heavily weighted. On the other hand, if the target key velocity rv is relatively large, the position gain kx is constant. The contact value of the position gain kx is experimentally determined. The feedback control loop 304B achieves the good promptness on the condition that the key is traveling at a relatively low speed. In other words, the feedback control loop 304B faithfully reproduces the key motion near the stop. The other control steps are similar to those of the first embodiment, and, for this reason, description is omitted for the sake of simplicity.

Figure 8A:
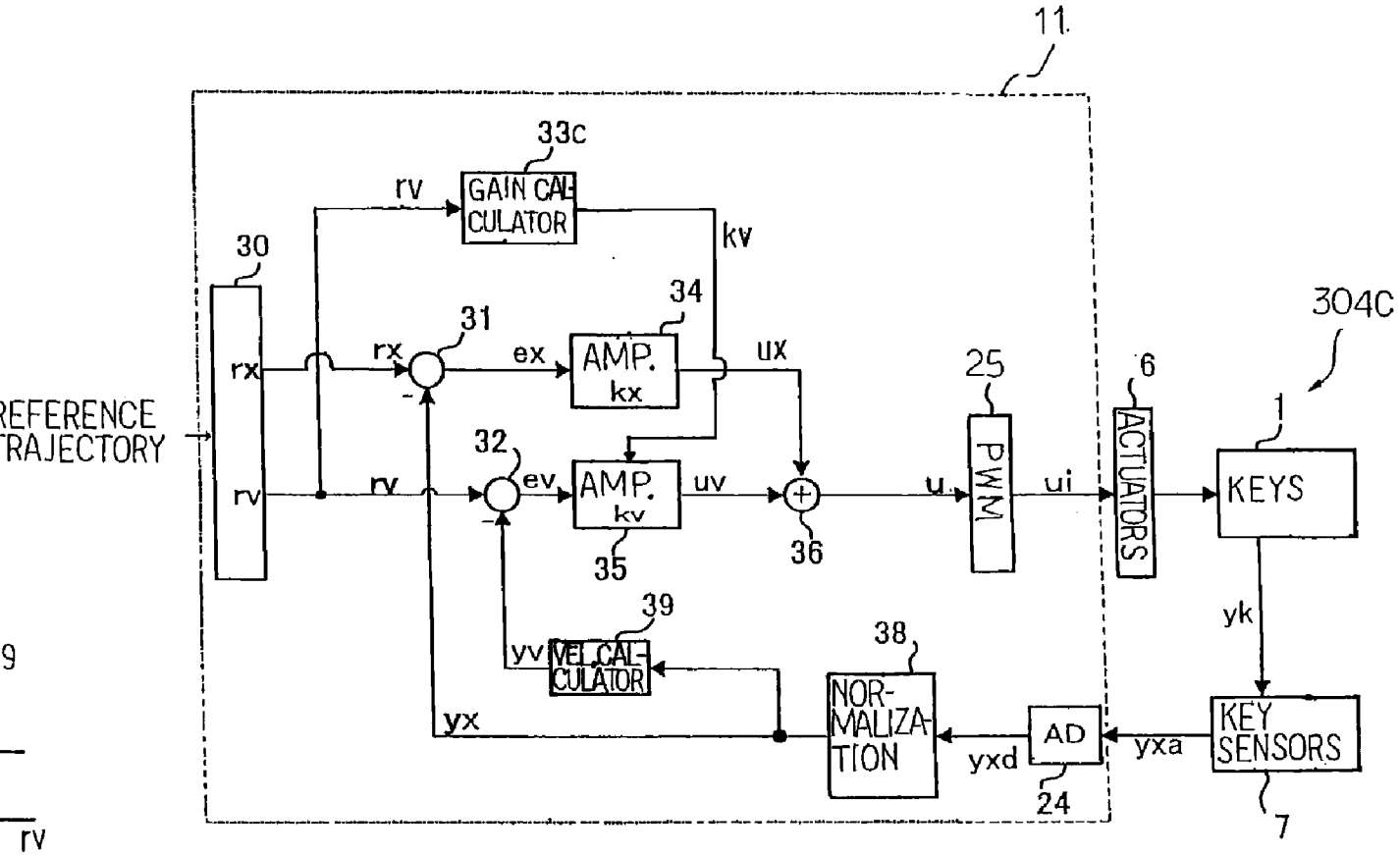
FIG. 8A is a block diagram showing yet another modification of the feedback control loop incorporated in the automatic player piano.
Figure 8B:
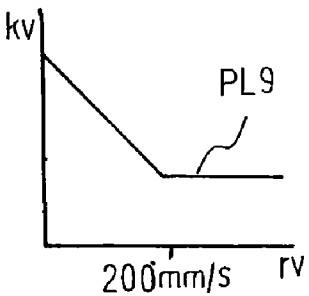
FIG. 8B is a graph showing a relation between a target key velocity and a velocity gain.

FIG. 8A shows a yet another modification 304C of the feedback control loop 304C. The gain calculator 33*c* accesses a gain table, which defines a relation between the target key velocity rv and the velocity gain kv as indicated by plots PL9 in figure 8B, so as to read out an appropriate value of the velocity gain kv. The velocity gain kv is supplied to the amplifier 35, and the velocity deviation ev is multiplied by the value of the velocity gain kv. In this instance, the velocity gain kv is reduced in inverse proportion to the target key velocity rv until the target key velocity rv of 200 millimeters per second, and is constant over 200 millimeters per second. Thus, the threshold is greater than the threshold of the second modification. With the variable velocity gain kv, the original key motion is faithfully reproduced.

Second Embodiment

Figure 9:
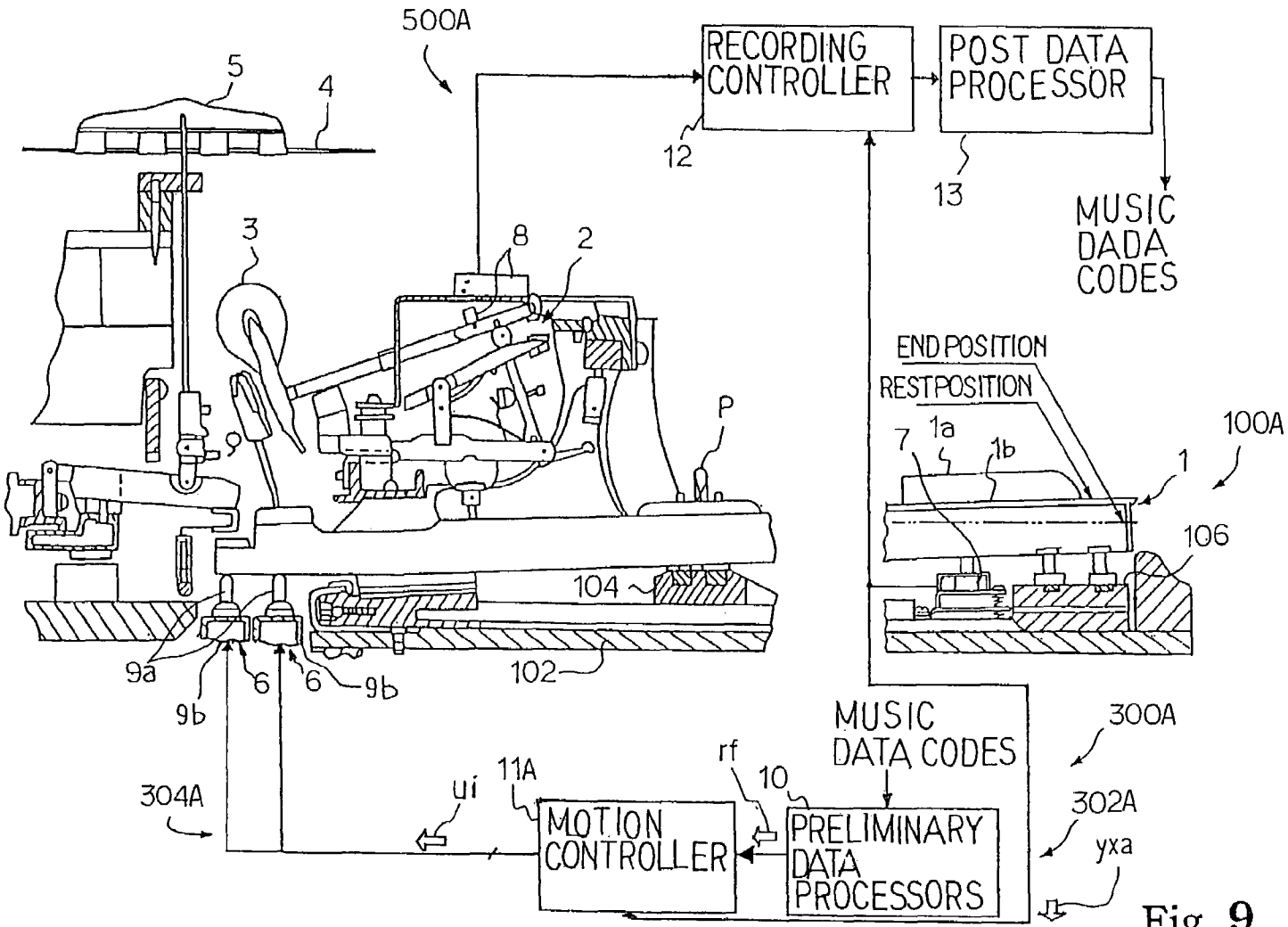
FIG. 9 is a schematic side view showing the structure of another automatic player piano according to the present invention.

Turning to FIG. 9 of the drawings, another automatic player piano embodying the present invention largely comprises an acoustic piano 100A, an automatic playing system 300A and a recording system 500A. The acoustic piano 100A and recording system 500A are similar to the acoustic piano 100 and recording system 500, and, for this reason, components of the acoustic piano 100A and components of the recording system 500A are labeled with the references designating the corresponding components of the acoustic piano 100 and references designating the corresponding components of the recording system 500 without detailed description. The keystroke is also 10 millimeters.

Figure 10:
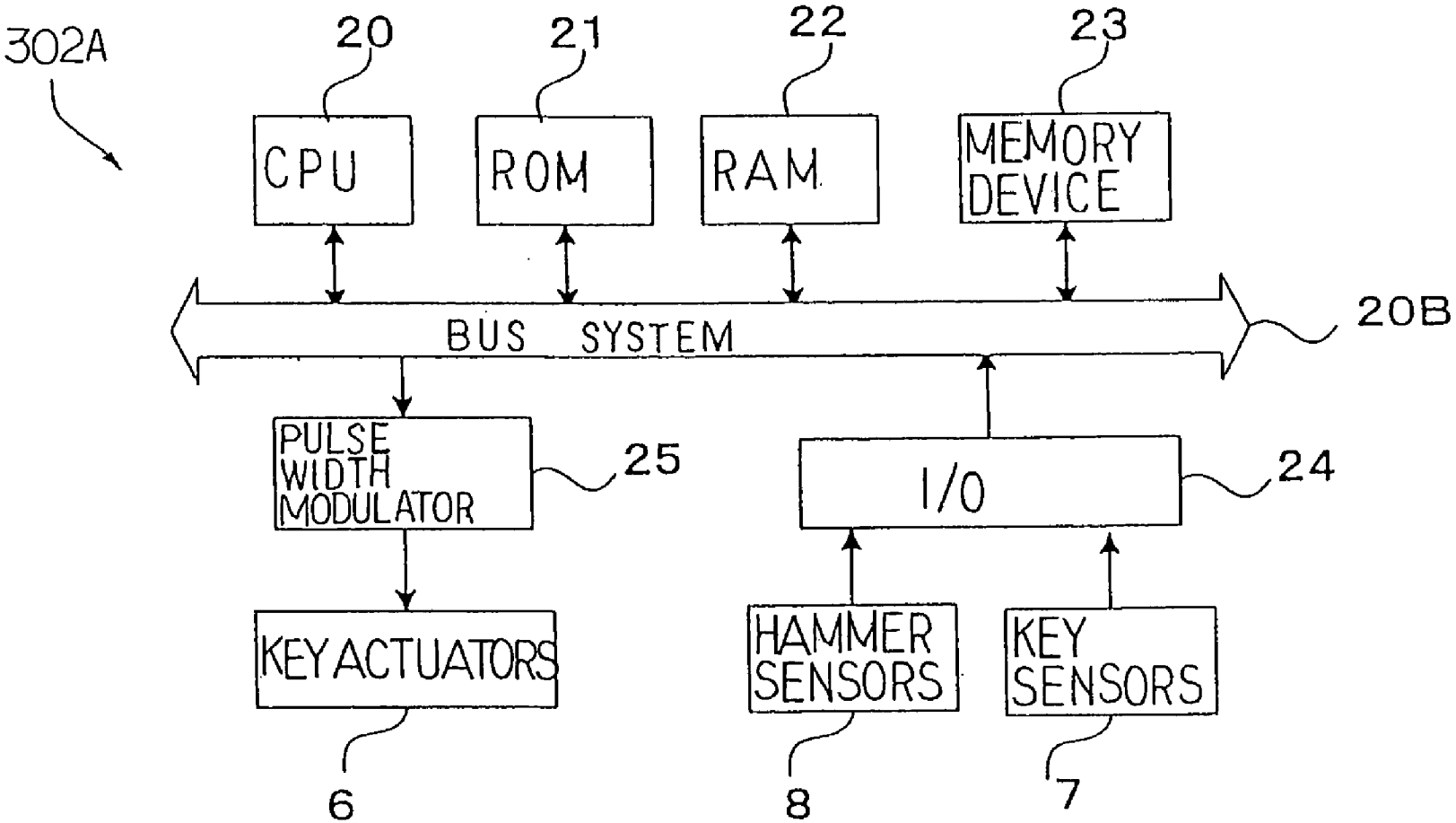
FIG. 10 is a block diagram showing the system configuration of a controller incorporated in the automatic player piano.

The automatic playing system 300A is similar in system configuration to the automatic playing system 300. However, the function of the motion controller 11A, which is incorporated in a controller 302A, is different from that of the motion controller 11. For this reason, the other system components are labeled with references designating corresponding system components of the automatic playing system 300 as shown in FIGS. 9 and 10.

The automatic playing system 500A behaves as follows. A set of music data codes is supplied from the memory device 22 or a data source (not shown) through a communication network (not shown) to the preliminary data processor 10. The preliminary data processor 10 sequentially processes the music data codes, and determines the black/white keys 1*a*/1*b* to be moved, a time at which each black/white key 1*a*/1*b* starts the key motion and a reference trajectory on which each black/white key 1*a*/1*b* is to travel for reenactment of the key event. When the time comes, the preliminary data processor 10 notifies the motion controller 11A of the reference trajectory, and the motion controller 11A supplies the driving signal ui to the black/white key 1*a*/1*b*. The associated key sensor 7 detects the current key position, and supplies the key position signal yxa representative of the current key position to the motion controller 11A. Then, the motion controller 11A starts the servo control on the black/white key 1*a*/1*b* through a feedback control loop 304A.

The reference trajectory is equivalent to a series of values of the target key position varied with time. If the black/white key 1*a*/1*b* exactly travels on the reference trajectory, the hammer 3 obtains the final hammer velocity expressed by the music data code. How to determine the reference trajectory is disclosed in the first laid-open.

When the motion controller 11A receives the piece of control data representative of the reference trajectory, the motion controller 11A determines the target key position at each moment, and regulates the mean current or duty ratio of the driving signal ui. Thus, the motion controller 11A forces the black/white keys 1*a*/1*b* to travel on the individual reference trajectories through the regulation on the driving signals ui.

As described hereinbefore, the solenoid-operated key actuators 6 are mechanically independent of the black/white keys 1*a*/1*b*, and the plunger motion is not strictly same as the key motion. In other words, even if the motion controller 11A optimizes the driving signals ui in consideration of the current key position, the driving signals ui merely cause the solenoid-operated key actuators 6 to vary the force exerted on the rear portions of the black/white keys 1*a*/1*b*, and the displacement is propagated from the rear portions to the front portions which are monitored with the key sensors 7. Conventionally, the weight of the plungers 9*a* and/or the weight of associated black/white keys 1*a*/1*b* is taken into account, and a certain constant bias is applied to the solenoids 9*b*. The constant bias causes the solenoid-operated key actuators 6 promptly to raise the plungers 9*a*. However, the constant bias is causative of the unstable key motion. When the string 4 is to be faintly struck with the hammer 3, the constant bias is so strong that the plunger 9*a* is violently brought into collision with the black/white key 1*a*/1*b*. If, on the other hand, the string 4 is to be strongly struck with the hammer 3, the constant bias can not give rise to the final hammer velocity equal to that in the original performance. Thus, the constant bias can not realize the faithful reenactment.

The motion controller 11A varies the bias depending upon the target key position and target key velocity as will be understood from the following description.

Figure 11:
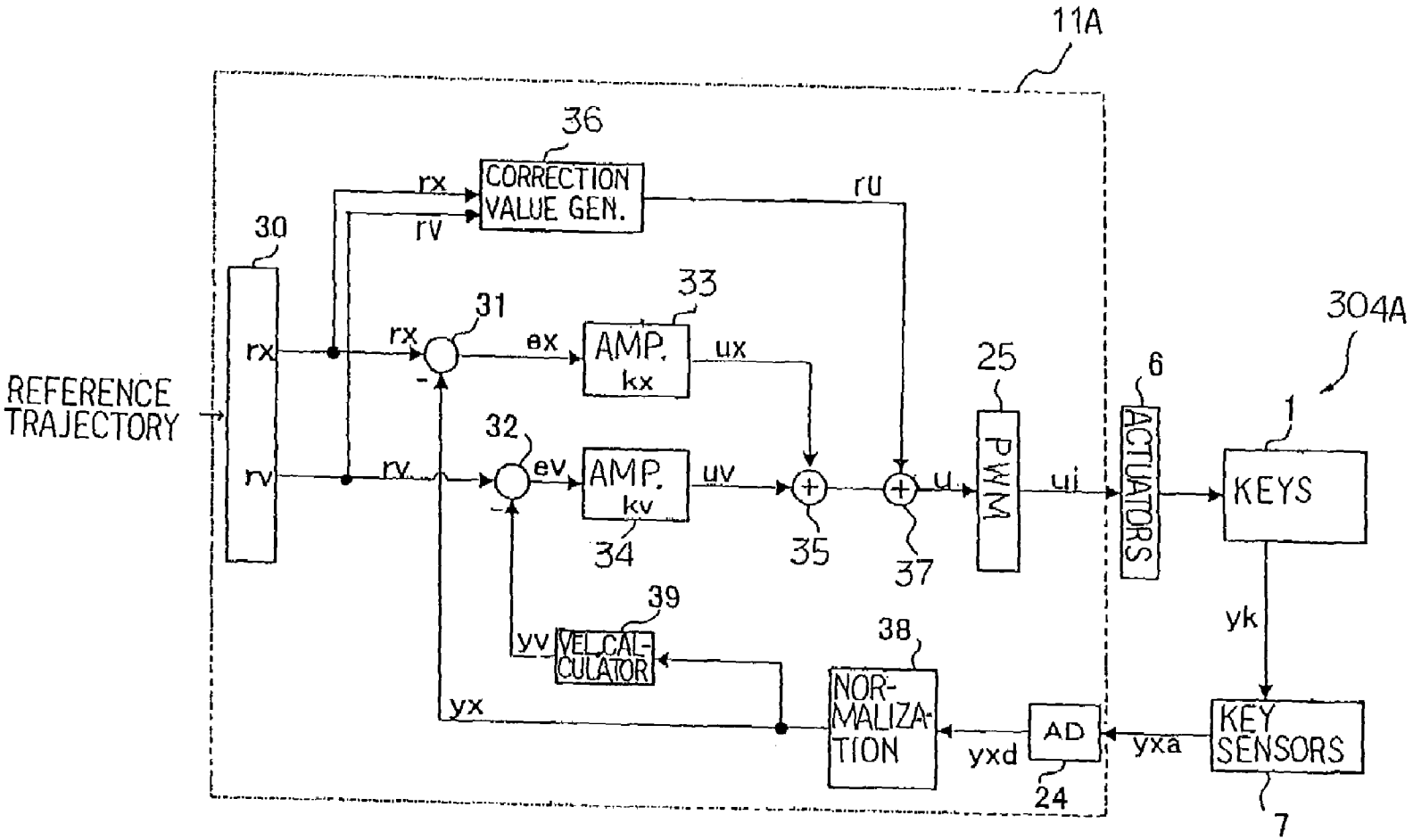
FIG. 11 is a block diagram showing the function of a feedback control loop incorporated in the automatic player piano.
Figure 13A:
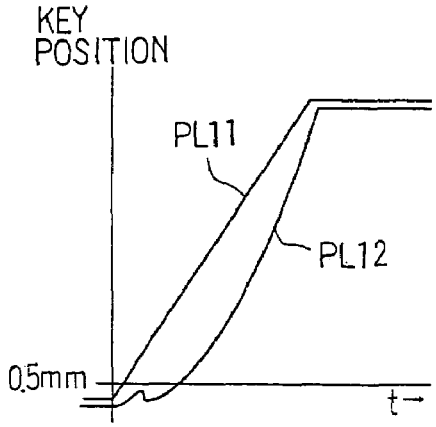
Fig. 13A PRIOR ART
FIG. 13A is a graph showing a reference trajectory and an actual trajectory under the condition that the correction value is fixed.
Figure 13B:
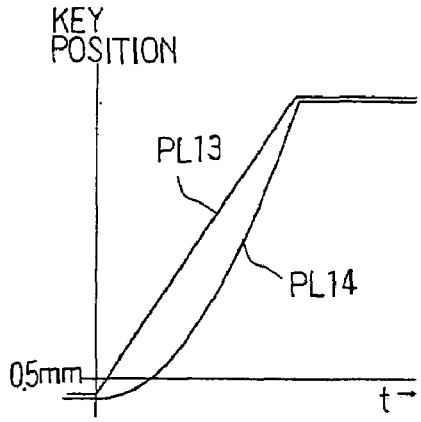
FIG. 13B is a graph showing a reference trajectory and an actual trajectory observed in the automatic player piano.
Figure 13C:
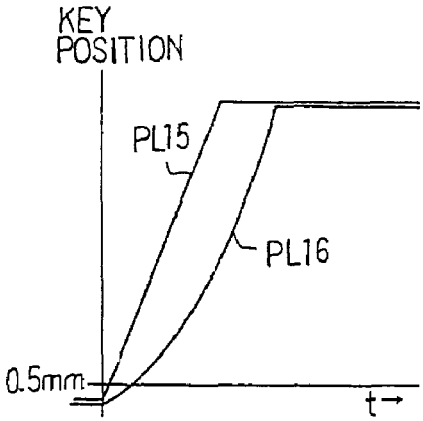
Fig. 13C PRIOR ART
FIG. 13C is a graph showing a reference trajectory and an actual trajectory under the condition that the correction value is fixed.
Figure 13D:
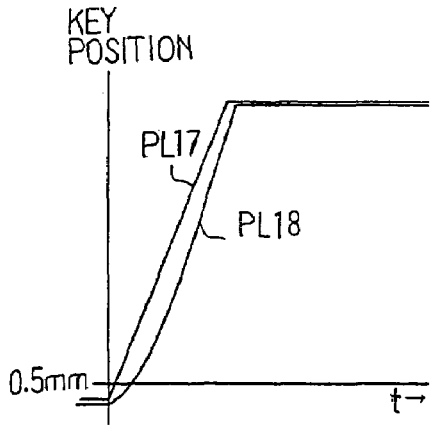
FIG. 13D is a graph showing a reference trajectory and an actual trajectory observed in the automatic player piano.

FIG. 11 illustrates the function of the feedback control loop 304A. Although the pulse width generator 25, solenoid-operated key actuators 6 and analog-to-digital converters 24 are implemented by respective circuits, the central processing unit 20 realizes the other functions through execution of computer programs.

The pieces of control data representative of the reference trajectories are supplied to a target value generator 30. The target value generator 30 outputs a target value of the key position and a target value of the key velocity at intervals of 1 millisecond, by way of example. Since the full keystroke between the rest position and the end position is of the order of 10 millimeters, the millimeter is used as unit. On the other hand, millimeter per second is used as the unit for the key velocity, and the target value of the key velocity ranges from zero to 500 millimeters/second.

The target value of the key position and target value of the key velocity are respectively supplied to subtractors 31 and 32 at intervals of 1 millisecond, and a current value of the key position and a current value of the key velocity are subtracted from the target value of the key position and the target value of the key velocity, respectively. The subtractors 31 and 32 respectively output a positional deviation ex and a velocity deviation ev, which are respectively supplied to the amplifiers 33 and 34. The positional deviation ex and velocity deviation ev are respectively multiplied by a constant gain kx and a constant gain kv, respectively, and the products ux and uv are added to each other through the adder 35. The product ux is indicative of a part of the mean current due to the positional deviation ex. On the other hand, the product uv is indicative of a part of the mean current due to the velocity deviation ev. Thus, the amplifiers 33 and 34 convert the units, i.e., millimeter and millimeter/second second to a value of the mean current or duty ratio.

The sum of products (ux+uv) is representative of a target value of the mean current or duty ratio. A correction value is added to the sum of products (ux+uv) through the adder 37. The target value of the key position rx and target value of the key velocity rv are supplied to the correction value generator 36, and the correction value generator 36 accesses a correction value table so as to read out an appropriate correction value. The correction value is indicative of a value of the mean current or duty ratio. In other words, the mean current or duty ratio is increased or decreased to the total of products (ux+uv) and correction value ru. The correction value table defines a relation between correction values and the target values.

FIG. 12 shows the correction value table. The target key position rx and target key velocity rv separate the correction value into four quadrants. In other words, the correction value is varied depending upon whether the pianist depressed the key strongly or softly and whether or not the key travels in the shallow region or the deep region. When the target key position rx and target key velocity rv are less than 0.5 millimeter and less than 100 millimeters per second, respectively, the correction value ru is 8%. If the target key velocity rv is increased to or over 100 millimeters per second, the correction value ru is also 8%. However, when the target key position rx is equal to or greater than 0.5 millimeter, the correction value ru is varied depending upon the target key velocity rv. If the target velocity rv is equal to or less than 100 millimeters per second, the correction value ru is 9%. When the target key velocity rv exceeds 100 millimeters per second, the correction value ru is given as $$ru=0.02\times(rv-100)+9\ [\%] \qquad \text{Equation 1}$$

When the black/white keys 1*a*/1*b* is expected to travel at a low speed, i.e., less than 100 millimeters per second, the correction value ru is either 8% or 9%. The correction value ru enhances the promptness of the key motion at the relatively low key velocity. Moreover, the correction value ru is relatively small, i.e., 8% in the shallow region regardless of the target key velocity rv. This results in that the plungers 9*a* are softly brought into contact with the associated black/white keys 1*a*/1*b*.

On the other hand, when the black/white keys 1*a*/1*b* enter the deep region, i.e., equal to or greater than 0.5 millimeter, the correction value ru is given by equation 1. The coefficient "0.02" is experimentally determined. The correction value ru is increased together with the target key velocity rv in the deep region equal to or greater than 0.5 millimeter. As a result, the black/white keys 1*a*/1*b* can promptly capture the target key positions.

As will understood from the foregoing description, the correction value ru, which is varied depending upon the target key position rx and target key velocity rv, is effective against the violent collision with the black/white keys 1*a*/1*b* and the key motion different from the original key motion.

Turning back to FIG. 11, the sum of products (ux+uv) and correction value ru is supplied to the pulse width modulator 25. The pulse width modulator 25 is responsive to the control signal representative of the total sum (ux+uv+ru) so as to vary the mean current or duty ratio of the driving signal ui. The total sum (ux+uv+ru) expresses a target value of the mean current or duty ratio so that the duty ratio is increased or decreased to (ux+uv+ru) from the previous duty ratio. The pulse width modulator 25 adjusts the driving signals ui to the target value of the duty ratio, and supplies the driving signals ui to the solenoid-operated key actuators 6.

The driving signals ui create respective magnetic fields around the plungers 9*a* so that the plungers 9*a* upwardly project from the solenoids 9*b*. The plungers 9*a* give rise to the key motion of the associated black/white keys 1*a*/1*b*. The black/white keys 1*a*/1*b* travel on the reference trajectories, and try to reach the target key positions rx at the end of the sampling period. The key sensors 7 monitor the black/white keys 1*a*/1*b*, and converts the current key positions yk to the analog key position signals yxa. The analog key position signals yxa are converted to digital key position signals yxd through the analog-to-digital converters 24, and the current key positions are normalized through the normalizer 38. The velocity calculator 39 determines the current key velocity on the basis of a predetermined numbers of the values of the current key position, Thus, the current key position yx and current key velocity yv are respectively supplied from the normalizer 38 and velocity calculator 39 to the subtractors 31 and 32 for the next target key position rx and next target key velocity rv.

The present inventors evaluated the feedback control loop 304A. FIGS. 13A, 13B, 13C and 13D show reference trajectories PL11, PL13, PL15 and PL17 and actual key trajectories PL12, PL14, PL16 and PL18.

When the correction value was fixed to 9%, the key traveled on plots PL12 at a relatively low key velocity less than 100 millimeters per second. On the other hand, when the correction value was varied depending upon the target key position and target key velocity as described hereinbefore, the key traveled on plots PL14 at the relatively low key velocity. Comparing plots PL12 with plots PL14, it was understood that the key motion was unstable in the shallow region, i.e., less than 0.5 millimeter due to the large correction value. In detail, the plunger 9*a* was violently brought into collision with the key, and the actual key position was momentarily peaked. This was because of the relatively large correction value, i.e., 9%. On the other hand, the plunger motion was stable in the shallow region as indicated by plots PL14 by virtue of the relatively small correction value, i.e., 8%. In the relatively deep region, the actual key trajectory PL12 became fairly closed to the reference trajectory PL11 as similar to the actual key trajectory PL14. Thus, the variable correction value was effective against the unstable key motion.

Plots PL16 and PL18 were indicative of the key motion at a relatively high key velocity greater than 100 millimeters per second. When the correction value was fixed to 9%, the actual key trajectory PL16 was gradually spaced from the reference trajectory PL15, and the deviation was serious in the deep region. On the other hand, the actual key trajectory PL18 is very closed to the reference trajectory PL17 over the full keystroke by virtue of the variable correction value ru given by equation 1. Since the correction value was relatively small, i.e., 8% in the shallow region, the key motion was stable in the shallow region.

As will be understood from the foregoing description, the correction value ru is varied depending upon the target key position and target key velocity in the automatic playing system 300A according to the present invention, and enhances the promptness of the black/white keys 1*a*/1*b* without sacrifice of the stability in the shallow region.

Figure 14:
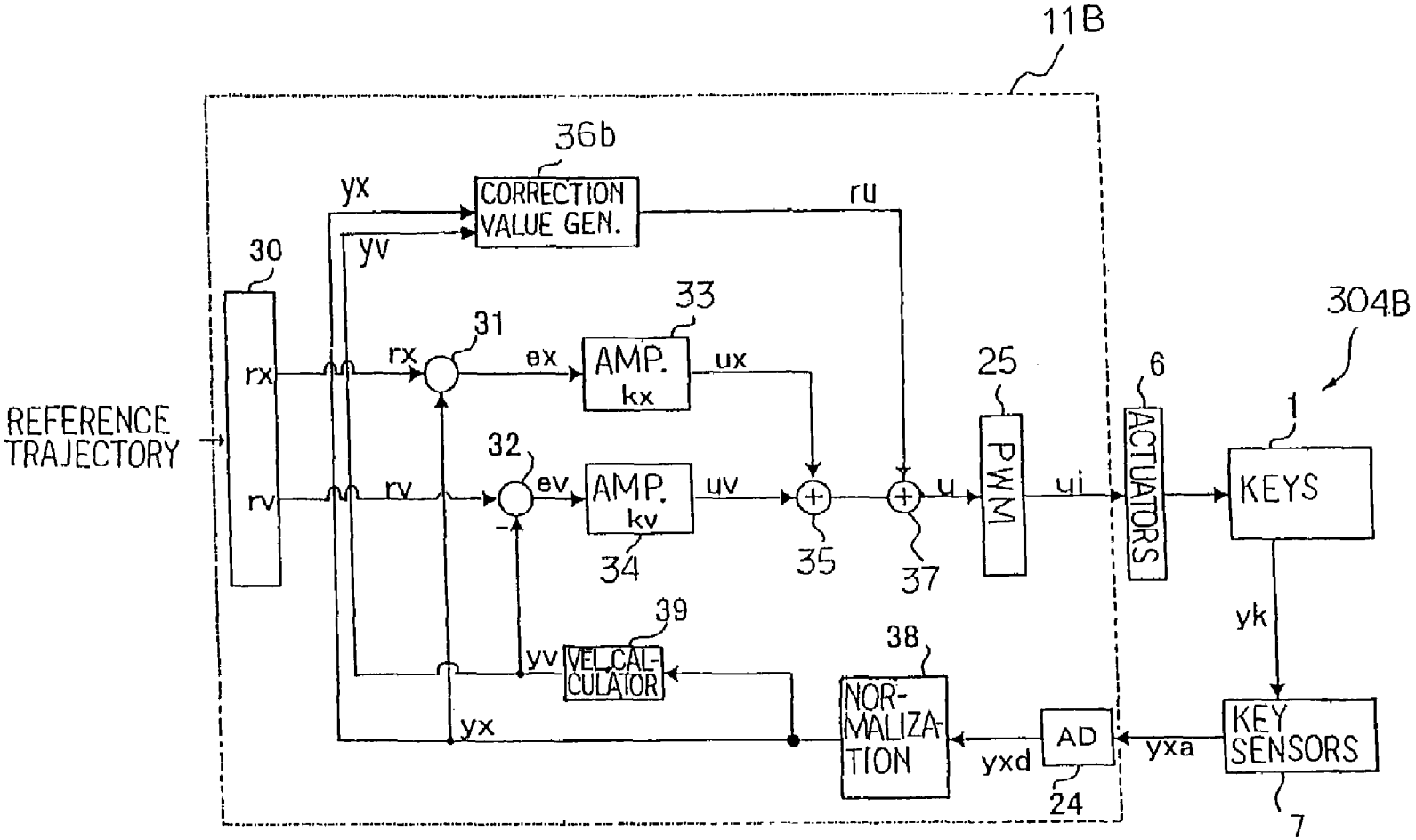
FIG. 14 is a block diagram showing the function of a feedback control loop incorporated in yet another automatic player piano.

FIG. 14 shows a modification of the second embodiment. The modification is similar to the automatic player piano implementing the second embodiment except for a feedback control loop 304B, especially, the function of a motion controller 11B. For this reason, description is focused on the feedback control loop 304B.

A correction value table, which defines a relation between the correction value ru and the current key position/current key velocity yx/yv, is stored in the read only memory 21 or random access memory 22. The correction value generator 36*b* is supplied with the current key position and current key velocity yx/yv. In the correction value table, different correction values are correlated with the current key position yx and current key velocity yv. The correction value generator 36*b* accesses the correction value table once in each sampling time period, and reads out an appropriate correction value ru from the correction value table. The other function is same as that of the feedback control loop 304A, and no further description is incorporated for the sake of simplicity.

The correction values may be correlated either current key position or current key velocity. A current acceleration may be further correlated with the correction values.

Third Embodiment

Figure 15:
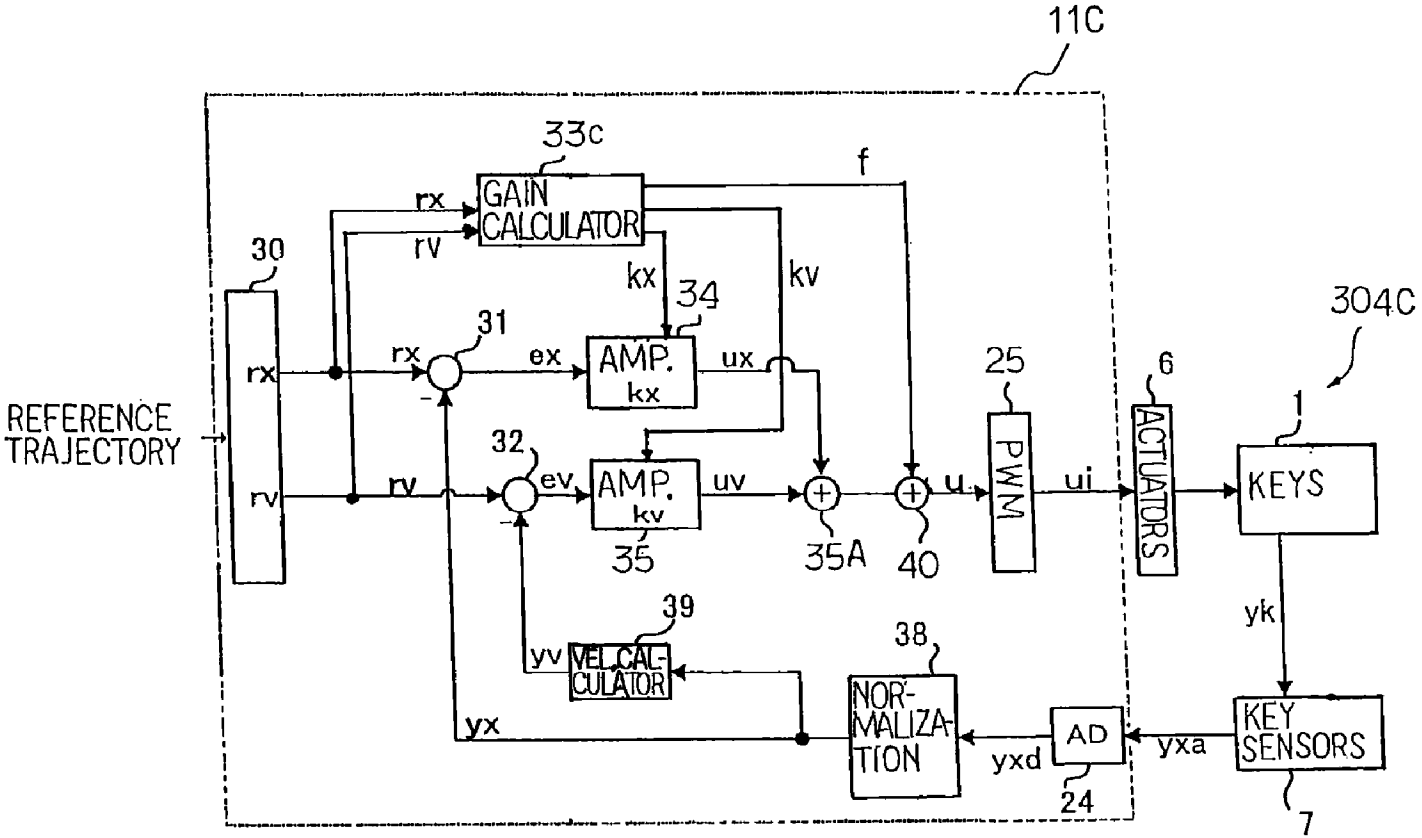
FIG. 15 is a block diagram showing the function of a feedback control loop incorporated in still another automatic player piano.

Turning to FIG. 15, yet another feedback control loop 304C is incorporated in an automatic player, which forms a part of an automatic player piano embodying the present invention. The acoustic piano, recording system and automatic playing system are similar to the acoustic piano 100, recording system 500 and automatic playing system 300 except for the function of a motion controller 11C. For this reason, the component parts and system components are labeled with references designating the corresponding component parts and corresponding system components without detailed description for avoiding undesirable repetition.

Comparing FIG. 15 with FIG. 3, an adder 40 is newly inserted between the adder 35A and the pulse width modulator 25, and the gain calculator 33 is replaced with another gain calculator 33*c*. The other function of the motion controller 11C is similar to the function of the motion controller 11 so that description is focused on the gain calculator 33*c* and adder 40.

A gain table, which defines a relation between the target key position/target key velocity and a positional gain/a velocity gain/a correction value (kx/kv/f) as shown in FIG. 16, is stored in the read only memory 21 or random access memory 22, and the gain calculator 33*c* accesses the gain table once in each sampling time period.

The position gain kx, velocity gain kv and correction value f are varied depending upon the ombination of target key position rx and target key velocity rv. In this instance, the key motion is categorized into four groups. The key motion in the first group is featured by the target key position rx between zero to 4 millimeters below the rest position and the target key velocity rv equal to or less than 200 millimeters per second. The key motion in the second group is featured by the target key position rx between 4 millimeters below the rest position and the end position, i.e., 10 millimeters below the rest position and the target key velocity rv equal to or less than 200 millimeters per second. The key motion in the third group is featured by the target key position rx between zero to 4 millimeters below the rest position and the target key velocity rv greater than 200 millimeters per second. The key motion in the fourth group is featured by the target key position rx between 4 millimeters below the rest position and the end position and the target key velocity rv greater than 200 millimeters per second.

The gain calculator 33*c* is assumed to determine that the key motion is categorized in the first group. Then, 0.6, 0.3 and 9% are read out from the gain table as the position gain kx, velocity gain kv and correction value f, and are supplied to the amplifier 34, amplifier 35 and adder 40, respectively. When the gain calculator 33*c* categorizes the key motion in the second group, 0.2, 0.3 and 9% are read out from the gain table as the position gain kx, velocity gain kv and correction value f, and are supplied to the amplifier 34, amplifier 35 and adder 40, respectively. Thus, while the black/white keys 1*a*/1*b* are traveling at a relatively low velocity equal to or less than 200 millimeters per second, the velocity gain kv and correction value f are constant, and the position gain kx is varied depending upon the target key position rx.

On the other hand, while the black/white keys 1*a*/1*b* is traveling at an ordinary key velocity greater than 200 millimeters per second, the key motion is categorized in the third group or the fourth group. When the key motion is categorized in the third group, 0.6 and 0.3 are read out from the gain table as the position gain kx and velocity gain kv, and the correction value f is calculated as $$f=9+2\times(rv-200)/100[\%] \qquad \text{Equation 2}$$

If the key motion is categorized in the fourth group, 0.2 and 0.3 are read out from the gain table as the position gain kx and velocity gain kv, and the correction value f is expressed by equation 2.

The positional deviation ex and velocity deviation ev are multiplied by the position gain kx and velocity gain kv, and the products ux and uv are added to each other through the adder 35A. The sum of products (ux+uv) is supplied to the next adder 40, and the correction value f is further added to the sum of products (ux+uv+f). The total sum (ux+uv+f) is indicative of a target value of the duty ratio, and is supplied to the pulse width modulator 25.

Since the correction value f is increased together with the target key velocity rv, the black/white keys 1*a*/1*b* promptly follows the target key position rx under the high key velocity.

As will be appreciated from the foregoing description, the variable controlling parameters such as, for example, the position gain kx, velocity gain kv and correction value ru/f make the feedback control loop 304/304A/304B/304C exactly reproduce the original key motion. As a result, the automatic playing system faithfully reenacts the original performance through the exactly reproduced key motion.

Although particular embodiments of the present invention have been shown and described, it will be apparent to those skilled in the art that various changes and modifications may be made without departing from the spirit and scope of the present invention.

The optical key sensors 7 do not set any limit to the technical scope of the present invention. A magnetic position transducer may be used in the automatic player piano. Similarly, the position transducers do not set any limit to the technical scope of the present invention. The key sensors 7 and/or hammer sensors 8 may be implemented by velocity sensors or acceleration sensors. The key position and hammer position are determined through the integration of the key velocity/hammer velocity. The feedback signal may be obtained from plunger sensors, which monitor the association plungers 9*a*.

The feedback control loops 304/304A, 304B or 304C may be provided for pedals such as a damper pedal, soft pedal and sostenuto pedal. Thus, the black/white keys 1*a*/1*b* do not set any limit to the technical scope of the present invention.

The acoustic piano 100 does not set any limit to the technical scope of the present invention. The automatic playing system 300, 300A or 300C may be incorporated in another sort of keyboard musical instrument such as, for example, an upright piano or a harpsichord. The keyboard musical instrument further does not set any limit to the technical scope of the present invention. The automatic playing system may be provided for another sort of musical instrument such as, for example, a percussion instrument. A typical example of the percussion instrument is a celesta.

The computer programs and data tables may be loaded to the random access memory 22.

The central processing unit 20 and computer programs do not set any limit to the technical scope of the present invention. The functions of recording controller, post data processor, preliminary data processor and motion controller 13/12/10/11 may be partially or entirely replaced with suitable logic circuits and signal lines.

The pulse width modulator 25 does not set any limit to the technical scope of the present invention. Another sort of driver circuit, which varies the potential level of the driving signals ui, may be incorporated in the controllers 11/11A/11B.

A set of music data codes is produced in cooperation between the acoustic piano 100 and the recording system 500. However, a set of music data codes may be prepared through another musical instrument or a personal computer system. In this instance, the set of music data codes is loaded to the random access memory through a communication network or a portable information storage medium such as, for example, a flexible disk or a compact disk. When the user instructs the automatic playing system to perform the piece of music expressed by the set of music data codes, the automatic playing system controls the acoustic piano to produce the tones. Thus, the automatic playing system not only reproduces but also produces the tones on the basis of the music data codes.

The gain table does not set any limit to the technical scope of the present invention. The motion controller 11 may determine the gain kx by using a suitable equation. In this instance, the target key position rx is expressed by a set of parameters, and the variables of the equation are substituted by the parameters. Of course, the set of values of the gain, i.e., 0.3 and 0.9 is an example. Another set of values of the gain kx may be appropriate to another model of the automatic player piano.

In the first embodiment and modifications, one of the position gain kx and velocity gain kv is varied depending upon the target key position or target key velocity. This feature does not set any limit to the technical scope of the present invention. Both gains kx and kv may be varied depending upon the target key position and/or target key velocity. The gains kx and kv may be determined depending upon the combination of the target key position and target key velocity. Moreover, acceleration may be further taken into account. A target acceleration is further calculated in the box 30, and an acceleration deviation is multiplied by an acceleration gain. One of the positional deviation and velocity deviation may be replaced with the acceleration deviation. Otherwise, the acceleration deviation is further taken into account together with the positional deviation and velocity deviation.

In the second embodiment, the criteria for the correction value ru are whether or not the target key position is less than 0.5 millimeter and whether or not the target key velocity is less than 100 millimeters per second. However, these thresholds, i.e., 0.5 millimeter and 100 millimeters per second may be different in another model. Moreover, the correction value may be determined depending upon either target key position rx or target key velocity rv. A target acceleration may be the third criterion for the correction value ru. Thus, the criteria and thresholds do not set any limit to the technical scope of the present invention.

The coefficient "0.02" is also appropriate for the model of the acoustic piano 100, and another value may be appropriate for another model of the acoustic piano. Thus, the coefficient does not set any limit to the technical scope of the present invention.

The correction value ru in the fast key motion in the deep region may be expressed by a quadratic curve or another function. In other words, equation 1 does not set any limit to the technical scope.

In the third embodiment, the position gain kx and velocity gain kv are fixed to 0.6/0.2 and 0.3. In a modification of the third embodiment, the position gain kx and velocity gain kv may be varied depending upon the key velocity and/or key position so that the actual key trajectories are almost consistent with the reference trajectories. In other words, it is possible to optimize the key motion by using the position gain kx, velocity gain kv and correction value f. The keystroke may be divided into more than two regions. Similarly, the key velocity may be divided into more than two regions. Thus, the gain table shown in FIG. 16 does not set any limit to the technical scope of the present invention.

In another modification of the third embodiment, the current key position yx and current key velocity yv may be supplied to the gain calculator 33*c*.

Claim languages are correlated with the component parts of the embodiments as follows. The acoustic piano 100 is corresponding to an "acoustic musical instrument". The black keys 1*a* and white keys 1*b* serve as "plural manipulators", and the action units 2, hammers 3 and strings 4 as a whole constitute a "tone generator". The solenoid-operated key actuators 6 serve as "plural actuators", and the key sensors 7 are corresponding to "plural sensors". The key position signals yxa serve as "detecting signals", and the driving signals ui are corresponding to "driving signals". "Magnitude" means the mean current or duty ratio.

The current key position yx and current key velocity yv are corresponding to a "current physical quantity" and "another current physical quantity", respectively, and the target key position rx and target key velocity rv are corresponding to a "target physical quantity" and "another target physical quantity", respectively. The music data codes express "pieces of music data". The position deviation ex and velocity deviation ev serve as "deviations". The position gains kx, velocity gains kv and/or correction values ru/f serve as "control parameters".

The fixed value of the position gain kx or fixed value of velocity gain kx serves as "another control parameter having a constant value". In the first embodiment, a "threshold" is 3 millimeters from the rest positions (see FIG. 4), 200 millimeters per second (see FIG. 8B), 5 millimeters (see FIG. 6B) and 50 millimeters per second (see FIG. 7B).

What is claimed is:

1. An automatic player musical instrument for producing tones, comprising:

an acoustic musical instrument including plural manipulators selectively manipulated for specifying tones to be produced, and a tone generator connected to said plural manipulators and responsive to motion of the manipulators so as to produce said tones specified through the manipulated manipulators; and an automatic playing system including plural actuators provided for said plural manipulators and responsive to driving signals so as to give rise to actual motion of said manipulators for producing said tones, plural sensors monitoring said plural manipulators and producing detecting signals representing a current physical quantity which expresses said actual motion, a controller connected to said plural sensors and determining reference trajectories each expressed by a target physical quantity varied with time on the basis of pieces of music data for the manipulators to be manipulated by said plural actuators, at least another current physical quantity on the basis of said current physical quantity, at least another target physical quantity on the basis of said target physical quantity, deviations at least between said current physical quantity and said target physical quantity and between said another current physical quantity and said another target physical quantity, control parameters at least one of which is varied depending upon one of said actual motion and a target motion on said reference trajectories and an optimum magnitude of said driving signals through an arithmetic operation between said deviations and said control parameters, and a signal modulator connected between said controller and said plural actuators, regulating each driving signal to said optimum magnitude and supplying said each driving signal to the actuator associated with one of said manipulators to be manipulated.

2. The automatic player musical instrument as set forth in claim 1, in which said at least one of the control parameters is varied depending upon said target physical quantity.

3. The automatic player musical instrument as set forth in claim 2, in which the deviation between said target physical quantity and said current physical quantity is multiplied with said at least one of said control parameters.

4. The automatic player musical instrument as set forth in claim 3, in which said target physical quantity and said current physical quantity are a position.

5. The automatic player musical instrument as set forth in claim 4, in which said at least one of said control parameters is decreased when said target physical quantity exceeds a threshold.

6. The automatic player musical instrument as set forth in claim 3, in which the deviation between said another target physical quantity and said another current physical quantity is further multiplied by another of said control parameters having a constant value for producing a product, wherein the product between said deviation and said at least one of said control parameters is added to the product between said deviation and said another of said control parameters for determining said optimum magnitude.

7. The automatic player musical instrument as set forth in claim 2, in which the deviation between said another target physical quantity and said another current physical quantity is multiplied by said at least one of said control parameters.

8. The automatic player musical instrument as set forth in claim 7, in which said another target physical quantity and said another current physical quantity is a velocity, and said target physical quantity and said current physical quantity is a position.

9. The automatic player musical instrument as set forth in claim 8, in which said at least one of said control parameters is increased when said target physical quantity exceeds a threshold.

10. The automatic player musical instrument as set forth in claim 7, in which the deviation between said target physical quantity and said current physical quantity is multiplied by another of said control parameters having a constant value, and the product between said deviation and said at least one of said control parameters is added to the product between said deviation and said another of said control parameters for determining said optimum magnitude.

11. The automatic player musical instrument as set forth in claim 1, in which said at least one of the control parameters is varied depending upon said another target physical quantity.

12. The automatic player musical instrument as set forth in claim 11, in which the deviation between said target physical quantity and said current physical quantity is multiplied with said at least one of said control parameters.

13. The automatic player musical instrument as set forth in claim 12, in which said another target physical quantity is a velocity, and said target physical quantity and said current physical quantity are a position.

14. The automatic player musical instrument as set forth in claim 13, in which said at least one of said control parameters is gradually decreased until said another target physical quantity reaches a threshold, and is constant after said threshold.

15. The automatic player musical instrument as set forth in claim 12, in which the deviation between said another target physical quantity and said another current physical quantity is further multiplied by another of said control parameters having a constant value for producing a product, and in which the product between said deviation and said at least one of said control parameters is added to the product between said deviation and said another of said control parameters for determining said optimum magnitude.

16. The automatic player musical instrument as set forth in claim 11, in which the deviation between said another target physical quantity and said another current physical quantity is multiplied by said at least one of said control parameters.

17. The automatic player musical instrument as set forth in claim 16, in which said another target physical quantity and said another current physical quantity is a velocity, and said target physical quantity and said current physical quantity is a position.

18. The automatic player musical instrument as set forth in claim 17, in which said at least one of said control parameters is decreased until said another target physical quantity reaches a threshold, and is constant after said threshold.

19. The automatic player musical instrument as set forth in claim 16, in which the deviation between said target physical quantity and said current physical quantity is further multiplied by another of said control parameters having a constant value, and the product between said deviation and said at least one of said control parameters is added to the product between said deviation and said another of said control parameters for determining said optimum magnitude.

20. The automatic player musical instrument as set forth in claim 1, in which said at least one of said control parameters is varied depending upon a combination between said target physical quantity and said another target physical quantity.

21. The automatic player musical instrument as set forth in claim 20, in which said at least one of said control parameters is added to a sum of products between said deviations and others of said control parameters having constant values.

22. The automatic player musical instrument as set forth in claim 20, in which said target physical quantity and said current physical quantity are a position, and said another target physical quantity and said another current physical quantity are a velocity.

23. The automatic player musical instrument as set forth in claim 22, in which said at least one of said control parameters is added to a sum of products between said deviations and others of said control parameters having constant values.

24. The automatic player musical instrument as set forth in claim 23, in which said at least one of said control parameters is increased when said target physical quantity exceeds a threshold, and is gradually increased depending upon said another target physical quantity greater than another threshold after said target physical quantity exceeds said threshold.

25. The automatic player piano as set forth in claim 1, in which said at least one of said control parameters is varied depending upon a combination between said current physical quantity and said another current physical quantity.

26. The automatic player piano as set forth in claim 25, in which said at least one of said control parameters is added to a sum of products between said deviations and others of said control parameters having constant values.

27. The automatic player musical instrument as set forth in claim 25, in which said target physical quantity and said current physical quantity are a position, and said another target physical quantity and said another current physical quantity are a velocity.

28. The automatic player musical instrument as set forth in claim 27, in which said at least one of said control parameters is added to a sum of products between said deviations and others of said control parameters having constant values.

29. The automatic player musical instrument as set forth in claim 1, in which said at least one of said control parameters is varied depending upon a combination between said target physical quantity and said another target physical quantity, and another of said control parameters and yet another of said control parameters are also varied depending upon said combination so that said controller determines said optimum magnitude on the basis of said at least one of said control parameters, said another of said control parameters, said yet another of said control parameters and said deviations.

30. The automatic player musical instrument as set forth in claim 29, in which said deviations are respectively multiplied with said at least one of said control parameters and said another of said control parameters for producing products, and said yet another of said control parameters is added to said products for determining said optimum magnitude.

31. The automatic player musical instrument as set forth in claim 30, in which said target physical quantity and said current physical quantity are a position, and said another target physical quantity and said another current physical quantity are a velocity.

32. An automatic playing system for a musical instrument having manipulators and a tone generator, comprising:

plural actuators provided for said plural manipulators, and responsive to driving signals so as to give rise to actual motion of said manipulators for producing tones through said tone generator;

plural sensors monitoring said plural manipulators, and producing detecting signals representing a current physical quantity which expresses said actual motion;

a controller connected to said plural sensors, and determining reference trajectories each expressed by a target physical quantity varied with time on the basis of pieces of music data for the manipulators to be manipulated by said plural actuators, at least another current physical quantity on the basis of said current physical quantity, at least another target physical quantity on the basis of said target physical quantity, deviations at least between said current physical quantity and said target physical quantity and between said another current physical quantity and said another target physical quantity, control parameters at least one of which is varied depending upon one of said actual motion and a target motion on said reference trajectories and a target magnitude of said driving signals through an arithmetic operation between said deviations and said control parameters; and a signal modulator connected between said controller and said plural actuators, regulating each driving signal to said optimum magnitude, and supplying said each driving signal to the actuator associated with one of said manipulators to be manipulated.

33. The automatic playing system as set forth in claim 32, in which said at least one of the control parameters is varied depending upon said target physical quantity.

34. The automatic playing system as set forth in claim 32, in which said at least one of the control parameters is varied depending upon said another target physical quantity.

35. The automatic playing system as set forth in claim 32, in which said at least one of said control parameters is varied depending upon a combination between said target physical quantity and said another target physical quantity.

36. The automatic playing system as set forth in claim 32, in which said at least one of said control parameters is varied depending upon a combination between said current physical quantity and said another current physical quantity.

37. The automatic playing system as set forth in claim 32, in which said at least one of said control parameters is varied depending upon a combination between said target physical quantity and said another target physical quantity, and another of said control parameters and yet another of said control parameters are also varied depending upon said combination so that said controller determines said optimum magnitude on the basis of said at least one of said control parameters, said another of said control parameters, said yet another of said control parameters and said deviations.

38. A method for controlling manipulators of a musical instrument, comprising the steps of:

a) determining a reference trajectory expressed by a target physical quantity varied with time for one of said manipulators to be actuated on the basis of a piece of music data;

b) determining at least another target physical quantity on the basis of said target physical quantity;

c) determining a deviation between said target physical quantity and a current physical quantity expressing an actual motion of said one of said manipulators and another deviation between said another target physical quantity and at least another current physical quantity determined on the basis of said current physical quantity;

d) determining an optimum magnitude through an arithmetic operation between the deviations and control parameters, at least one of which is varied depending upon one of said actual motion and a target motion on said reference trajectories;

e) regulating a driving signal to said optimum magnitude;

f) supplying said driving signal to an actuator associated with said one of said manipulators; and g) repeating said steps b), c), d), e) and f) until said one of said manipulators arrives at a final target position.

* * * * *